US009782664B1

(12) United States Patent
Ritter

(10) Patent No.: US 9,782,664 B1
(45) Date of Patent: Oct. 10, 2017

(54) ANKLE AND TOE STRAPS FOR SPLITBOARD AND SNOWBOARD BINDINGS

(71) Applicant: Spark R&D IP Holdings, LLC, Bozeman, MT (US)

(72) Inventor: William J Ritter, Bozeman, MT (US)

(73) Assignee: SPARK R&D IP HOLDINGS, LLC, Bozeman, MT (US)

( * ) Notice: Subject to any disclaimer, the term of this patent is extended or adjusted under 35 U.S.C. 154(b) by 0 days.

(21) Appl. No.: 15/414,574

(22) Filed: Jan. 24, 2017

(51) Int. Cl.
*A63C 10/08* (2012.01)
*A63C 10/06* (2012.01)
*A63C 9/00* (2012.01)

(52) U.S. Cl.
CPC ..... *A63C 10/08* (2013.01); *A63C 9/002* (2013.01); *A63C 10/06* (2013.01)

(58) Field of Classification Search
CPC ..... A63C 10/08; A63C 10/06; A63C 10/28; A63C 9/002; A63C 9/06; A63C 9/065; A63C 9/24; A63C 9/245
USPC ..... 280/617, 619, 620, 621
See application file for complete search history.

(56) References Cited

U.S. PATENT DOCUMENTS 6,206,403 B1 * 3/2001 Black ..... A63C 10/06 280/14.22
D455,187 S 4/2002 Janisch
6,394,484 B1 5/2002 Maravetz et al.
6,938,904 B2 9/2005 Dalgaard
7,621,542 B2 11/2009 Warburton et al.
7,992,888 B2 8/2011 Steere
8,146,940 B2 * 4/2012 Hahnenberger ..... A63C 10/06 280/14.21
8,267,421 B2 9/2012 Krenn et al.
8,763,209 B2 * 7/2014 Kavarsky ..... A43C 11/1413 24/68 SK
9,266,010 B2 2/2016 Kloster et al.
2014/0210187 A1 7/2014 Ritter
2015/0360117 A1 12/2015 Markman

FOREIGN PATENT DOCUMENTS

DE 102008004989 A1 7/2008

OTHER PUBLICATIONS

Page from Arbor Snowboards Bindings, downloaded from the Internet at: http://arborcollective.com/snowboards/bindings/ on Jan. 2, 2017.
Page from Bent Metal Website, downloaded from the Internet at: http://www.bentmetal.com/bindings/transfer/ on Jan. 2, 2017.

(Continued)

*Primary Examiner* — John D Walters
(74) *Attorney, Agent, or Firm* — Stone Creek Services LLC; Alan M Flum

(57) ABSTRACT

Disclosed is a novel ankle strap and a toe strap that secures snowboard or splitboard rider's boots to corresponding boot bindings. The straps are generally made from a one-piece molding that includes indented portions on the outside surface of the molding that creates corresponding outdented portions on the boot-facing surface for cushioning. The indented portions are bound by ribs, the ribs forming a continuous interconnected rib structure. As the outdented portions flex, the continuous interconnected rib structure helps the strap maintain its shape and structure.

12 Claims, 23 Drawing Sheets

(56) References Cited

OTHER PUBLICATIONS

Page from Burton, downloaded from the Internet at: https://www.burton.com/us/en/burton-cartel-snowboard- binding/W17-105391.html?dwvar_W17- 105391_variationColor=10539103303 &cgid=mens-bindings on Jan. 2, 2017.
Screenshot from YouTube Video, Flux Bindings, downloaded from Internet at: https://www.youtube.com/embed/a0VrFWv1Z0w on Jan. 2, 2017.
From page of Karakoram website, Sieva Straps, accessed on the Internet at https://www.splitboardbindings.com/products/air-form-straps/ on Jan. 2, 2017.
Sieva Straps, image from Now Bindings website, accessed on the Internet at: https://now-snowboarding.com/products/accessories on Jan. 2, 2017.
Page from Now Bindings website, accessed on the Internet at: https://now-snowboarding.com/technology/binding-tech on Jan. 2, 2017.
LTD Bindings, page from Ride bindings website, accessed on the Internet at: http://ridesnowboards.com/bindings/ltd?color=blue on Jan. 2, 2017.
Myth S/M, page from Rossignol website, accessed on the Internet at: http://www.rossignol.com/US/US/myth-sm—2016—RGF0016— product—snowboard-men-bindings.html?b=41482 on Jan. 2, 2017.
Ankle Straps, page from SP website, accessed on the Internet at: http://www.sp-bindings.com/en/tech on Jan. 2, 2017.
Contract Pro, page from Union Binding Co. website, accessed on the Internet at: https://www.unionbindingcompany. com/snow-board-bindings/mens/union-contact-pro-bindings-2017 on Jan. 2, 2017.
Dayze, page from Union Binding Co. website, accessed on the Internet at: https://www.unionbindingcompany.com/snowboard-bindings/custom-house/union-dayze-bindings-2017# on Jan. 2, 2017.
Ultra, page from Union Binding Co. website, accessed on the Internet at: https://www.unionbindingcompany.com/snowboard-bindings/mens/union-ultra-bindings-2017#white on Jan. 2, 2017.
Voile Speed Rail Splitboard Binding, page from Voile website, accessed on the Internet at: http://www.voile.com/voile-speed-rail-binding.html on Jan. 2, 2017.
Voile Speed Rail Binding Ankle Straps, page from Voile website, accessed o the Internet at: http://www.voile.com/voile-speed-rail-binding-ankle-straps.html on Jan. 2, 2017.
Injection Molding Design Guideline, Stratasys, Los Angeles California, US, downloaded from the Internet at https://www.stratasysdirect.com/resources/injection-molding/ on Jan. 24, 2017.

* cited by examiner

ANKLE AND TOE STRAPS FOR SPLITBOARD AND SNOWBOARD BINDINGS

BACKGROUND

The present disclosure relates to boot bindings for snow gliding boards such as snowboards and splitboards. The disclosure particularly relates to ankle and toe straps for such boot bindings.

Snowboarding is a popular recreational activity where the rider glides down a snow-covered mountain, hill, or slope while standing with their feet attached to a single snow glide board known as a snowboard. The concept is similar to snow skiing except both feet are attached to a single snow glide board instead of each foot attached to its own separate ski.

Snowboard riders or "snowboarders" often share downhill snow-covered slopes with skiers. Popular downhill slopes are often accessed by ski lifts to take the skier or snowboarder up to the top of the slope. Some snowboarders are interested in accessing downhill slopes in the backcountry away from crowded ski slopes and where the snow is fresh. However, climbing up mountains and slopes with thick fresh soft snow can be challenging.

Splitboards were developed to allow snowboarders access to the backcountry and areas that are normally not accessible to snowboarders. A splitboard is a snowboard separable into two separate parts along the length of the board, with one foot bound to each portion of the board. To climb uphill, or "tour," the backcountry the splitboard rider, or "splitboarder," separates the splitboard and uses it like cross country skis. For the purpose of this disclosure, the term "rider" refers to person who rides a snowboard, splitboard, or other snow glide board. To ride downhill, the rider rejoins the two sections of the splitboard and rides the splitboard as they would an ordinary snowboard.

A boot binding, also referred to simply as "a binding," is a device for securing the rider's boots to the snowboard or splitboard. Two boot bindings, one for each of the rider's boots, are generally secured to the top surface of the snowboard or splitboard. Each of the rider's boots can be secured to a corresponding boot binding by one or more straps attached to the boot binding. In some designs, the boot bindings include an "ankle strap" that secures the upper portion of the boot near the ankle and a "toe strap" for securing the lower portion of the boot over the toes. The ankle straps and toe straps are generally padded to relieve pressure from the rider's boots and make the ride more comfortable. Padded straps are often constructed of a central spine made of plastic or other semi-rigid material, and covered with a layer of foam and sewn fabric. Other padded straps have been constructed of two layers of plastic. One soft padded layer faces the rider's boot surface. A second outward-facing layer adds structure to the strap.

SUMMARY

The inventor noted that because splitboards are often used in the backcountry and in remote locations, it is important for him to provide boot bindings that are durable and lightweight. The inventor observed that padded splitboard ankle and toe straps construction is often complex. This complexity affects durability and weight. For example, when riding a splitboard downhill, the bindings and straps are separated by a fixed distance. However, while touring, it is not uncommon for straps from each binding to rub against each other as the rider goes uphill. The fabric that covers the foam padding can wear and fray. The color on the fabric can get scratched and wear off.

The inventor discovered that he could create an ankle strap or toe strap that includes a one-piece molding and a pair of threaded inserts. The one-piece molding includes a series of indented portions on the outward-facing surfaces. These indented portions create a series of corresponding outdented portions on the boot-facing surface of the ankle strap. The outdented portions flex when pressed against the surface of the snowboarder's boot and act as cushioning while riding downhill or touring through the backcountry. The area between the indented portions on the outward-facing surface includes continuous ribbing running both laterally and length-wise along the one-piece molding. The length-wise ribbing has sufficient stiffness to help hold the one-piece molding in a semi-rigid arc-like (i.e. arcuate) shape. The length-wise ribbing is thicker (i.e. taller) near both length-wise ends of the strap. The arcuate shape approximates the outside upper radius of a typical snow boot where the strap contacts the boot. The lateral ribbing adds structure and stiffness around the indented portions. The resulting structure allows the softer body of the strap to conform to the boot while the ends of the strap, with attachments such as buckles, are held away from the boot.

This structure accomplishes the feel and performance of a strap that typically requires many more parts. The inventor's ankle and toe binding straps disclosed are durable and padded using a one-piece molding and two threaded inserts as opposed to conventional straps that often have a plastic or webbing spine, foam padding and a sewn cover. In addition, while the inventor set out to make a more durable and easy to manufacture ankle and toe strap for splitboard bindings, the inventor's strap provided several unexpected results.

The inventor observed that splitboard ankle and toe straps can affect the splitboarder's experience. Splitboarders can spend up to 75% of their time in the field walking uphill where extra padding is not necessary and extra strap weight can make the upward ascent more difficult. In addition, the stiffness of the strap can affect the ride. A flexible strap allows for more nimble riding as the splitboarder is less constrained and can make quick turns around obstacles like trees or rocks. A stiffer strap allows for faster riding as the splitboarder can put more of their weight into their turns rather than using only their muscles.

The inventor observed that he could adjust the performance of the strap by varying parameters of the design such as the height (thickness) of either the lateral or length-wise ribs, or the height of the length-wise ribs at only certain portions of the strap. Something not readily possible in other ankle and toe strap design that have many more parts to provide cushioning and structure. For example, the inventor found that he could adjust the height of the length-wise ribs at various points along the strap in order to change the feel and performance of the strap. Varying the height of a continuous rib goes against conventional wisdom. In general, injection molding handbooks recommend against such practices because it would tend to cause uneven flow of the injection molded material. They generally recommend making ribbing uniform.

The pair of threaded inserts are barbed at their ends and press fit into insert supports indented in the boot-facing surface of the one-piece molding near the strap ends between the thickened portion of two of the length-wise ribs. The insert support is comprised of a solid portion of the one-piece molding that projects outward from the outward-facing surface and projects inward from the boot-facing surface of the one-piece molding. By indenting the insert supports below the boot-facing surface, the inserts will not touch the splitboarder's boot. Buckles and length adjuster straps adjustably secure the ankle or toe strap to the boot binding. Threaded fasteners screwed into the threaded inserts secure the buckles to the strap. The threaded fastener screws into the threaded insert through the top surface of the insert supports that is positioned outward-facing surface of the one-piece molding. As the threaded fastener is tightened, it draws the barbed end of the threaded inserts further into the inserted support. With the threaded fasteners removed, the threaded inserts can be easily pried out for field replacement. In contrast, field servicing is generally not an option with typical foam padded and sewn binding straps or with molded two-piece straps where the threaded insert is overmolded into the structure.

While the inventor conceived his ankle and toe binding straps for a splitboard boot binding. He envisions that they can be readily used on conventional snowboards and snowboard boot bindings.

This Summary introduces a selection of concepts in simplified form that are described the Description. The Summary is not intended to identify essential features or limit the scope of the claimed subject matter.

DRAWINGS

DESCRIPTION

Figure 1:
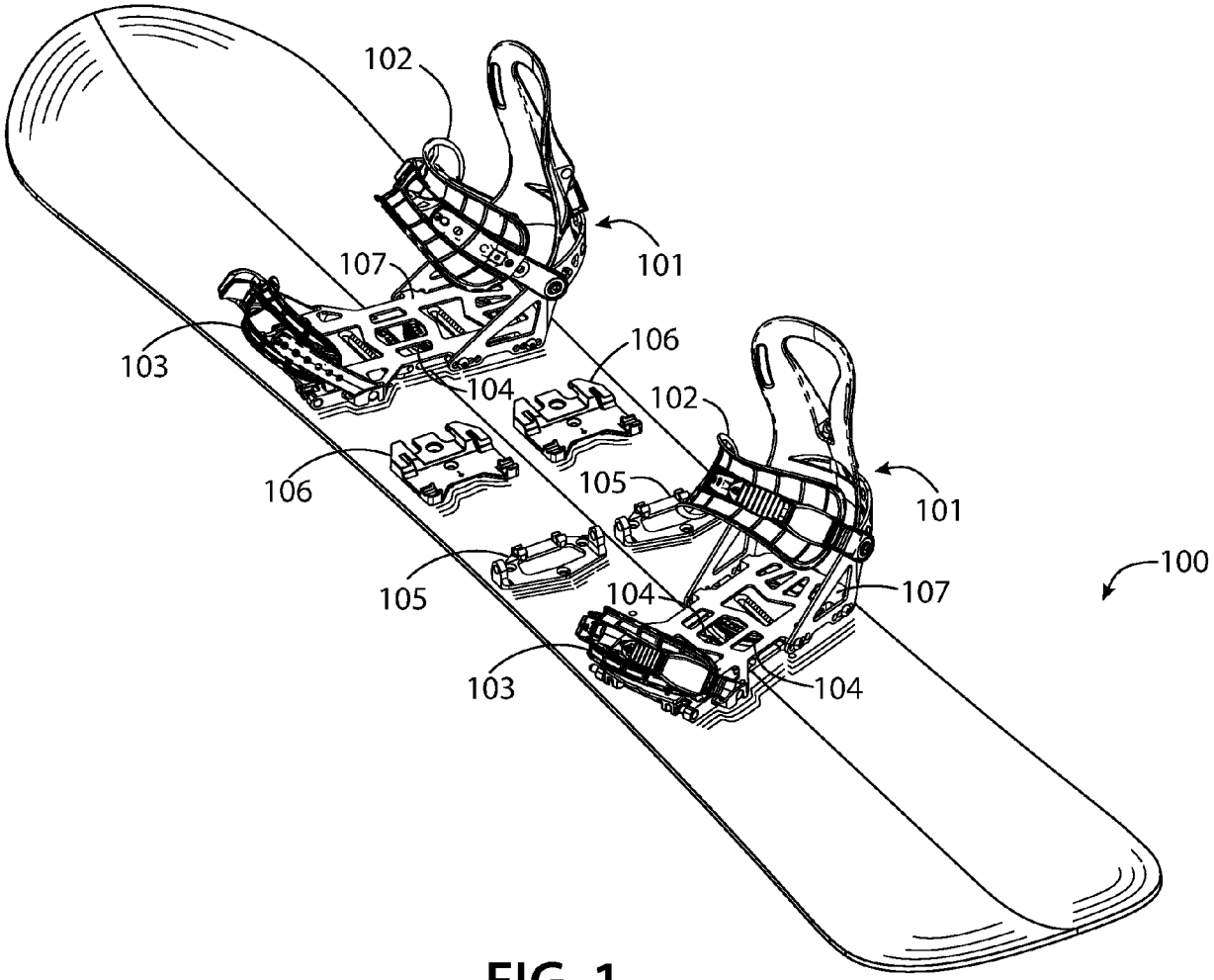
FIG. 1 illustrates a front and top perspective view of splitboard with attached boot bindings.

The terms "left," "right," "top, "bottom," "upper," "lower," "front," "back," and "side," are relative terms used throughout the to help the reader understand the figures. Unless otherwise indicated, these do not denote absolute direction or orientation and do not imply a particular preference. When describing the figures, the terms "top," "bottom," "front," "rear," and "side," are from the perspective of the device being mounted on a snow boot. For example, a front elevation view of an ankle strap 102, ankle strap 202, ankle strap 302, ankle strap 402, ankle strap 502, or a toe strap 103 is illustrated looking toward the front of the boot. A rear elevation view of the ankle strap 102, ankle strap 202, ankle strap 302, ankle strap 402, ankle strap 502, or the toe strap 103 is illustrated looking toward the rear of the boot. A top plan view of the ankle strap 102, ankle strap 202, ankle strap 302, ankle strap 402, ankle strap 502, or the toe strap is illustrated looking toward the top of the boot. Specific dimensions are intended to help the reader understand the scale and advantage of the disclosed material. Dimensions given are typical and the claimed invention is not limited to the recited dimensions.

The following terms are used throughout this disclosure and are defined here for clarity and convenience.

One-piece molding: As defined in this disclosure, a one-piece molding is a molded part, typically injection molded, that is made in one pass or one-shot. In the injection molding industry, this is also known as one-shot injection molding or a one-shot injection molded part.

Non-perimeter rib: As defined in this disclosure, a non-perimeter rib is a rib that does not extend around the perimeter of the one-piece molding. Examples of non-perimeter ribs include lateral ribs 124 and length-wise ribs 125 as illustrated in FIGS. 4, 5, 7, 8, 10, 11, 13-15, 17, 18, 20, 21, 24, 26, 27, 29, 34, 36, 38, 40-42, and 44.

Perimeter rib: As defined in this disclosure, a perimeter rib is a molded rib the extends around the perimeter of the one-piece molding.

Lateral rib: As defined in this disclosure, a lateral rib is a molded rib that extends along the width of the one-piece molding. A lateral rib can extend partially across the width of the one-piece molding. Alternatively, a lateral rib can extend fully across the width of the one-piece molding. Examples of lateral ribs 124 are shown in FIGS. 4, 5, 7, 8, 10, 11, 13-15, 17, 18, 20, 21, 24, 26, 27, 29, 34, 36, 38, 40-42, and 44. These examples are not meant to limit the meaning of "lateral rib," but to aid the reader in understanding different variations of lateral rib conceived by the inventor.

Length-wise rib: A defined in this disclosure, a length-wise rib is a molded rib that extends along the length of the one-piece molding. A length-wise rib can extend partially across the length of the one-piece molding. For example, in FIG. 36 the length-wise ribs 125 extend from either length-wise end of the one-piece molding 118 but do not extend across the entire length. Alternatively, a length-wise rib can extend fully across the length of the one-piece molding. For example, in FIGS. 7, 17, 24, 27, 40, and 44 the length-wise ribs 125 extend across the entire length of the one-piece molding 118. The examples given here are not meant to limit the definition of "length-wise rib," but to aid the reading in understanding several variations that are within the intended scope of this disclosure.

Continuous interconnected ribbed structure: As defined in this disclosure, a continuous interconnected ribbed structure means three or more ribs joined together continuously by injection molding and thereby forming a continuous and integral structure.

The following description is made with reference to figures, where like numerals refer to like elements throughout the several views, FIG. 1 illustrates a front top perspective view of splitboard 100 with boot bindings 101 attached. The boot bindings are illustrated with an ankle strap 102 and toe strap 103. The splitboard is shown in "riding mode." In this configuration, with the two halves of the splitboard 100 are secured to each other, the rider can use the splitboard 100 like a snowboard to ride downhill. The two halves of the splitboard 100 are typically secured by hooks along the length of the board known as "split hooks," and by clips at both ends of the board known as "tip and tail hooks." For simplicity, the hooks and clips are not illustrated. In riding mode, the boot binding 101 is secured to pucks 104 that are attached to the splitboard 100. In order to go uphill or tour the backcountry, the rider separates the two halves of the splitboard 100 by removing the boot bindings 101 and unlatching the tip and tail hooks, and uses the two halves like cross country skis. In touring mode, the boot bindings 101 are attached to the touring brackets that comprise a toe pivot 105 and a heel block 106.

Figure 2:
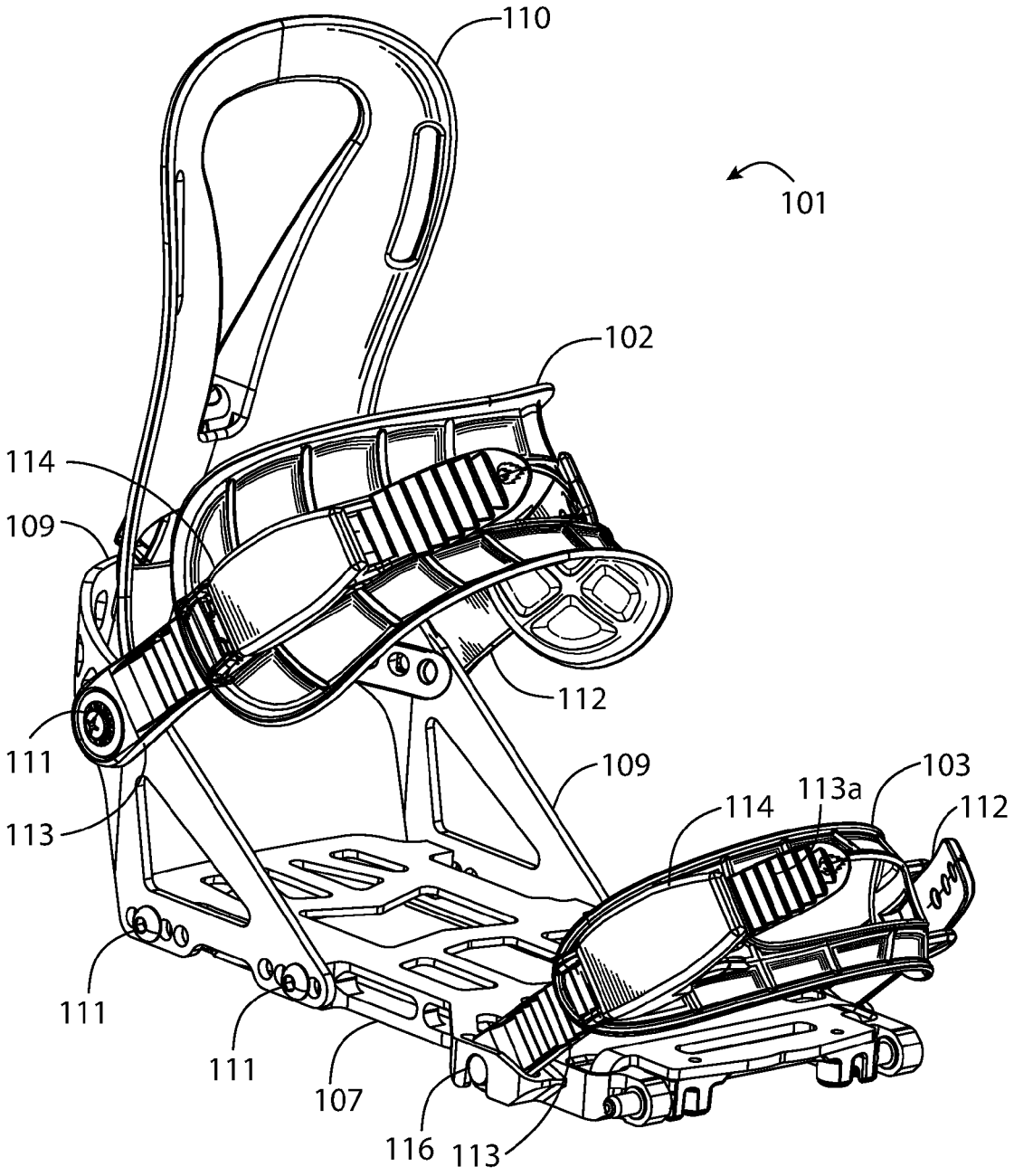
FIG. 2 illustrates a front and top perspective view of a boot binding of FIG. 1 illustrating a novel ankle strap and toe strap.
Figure 3:
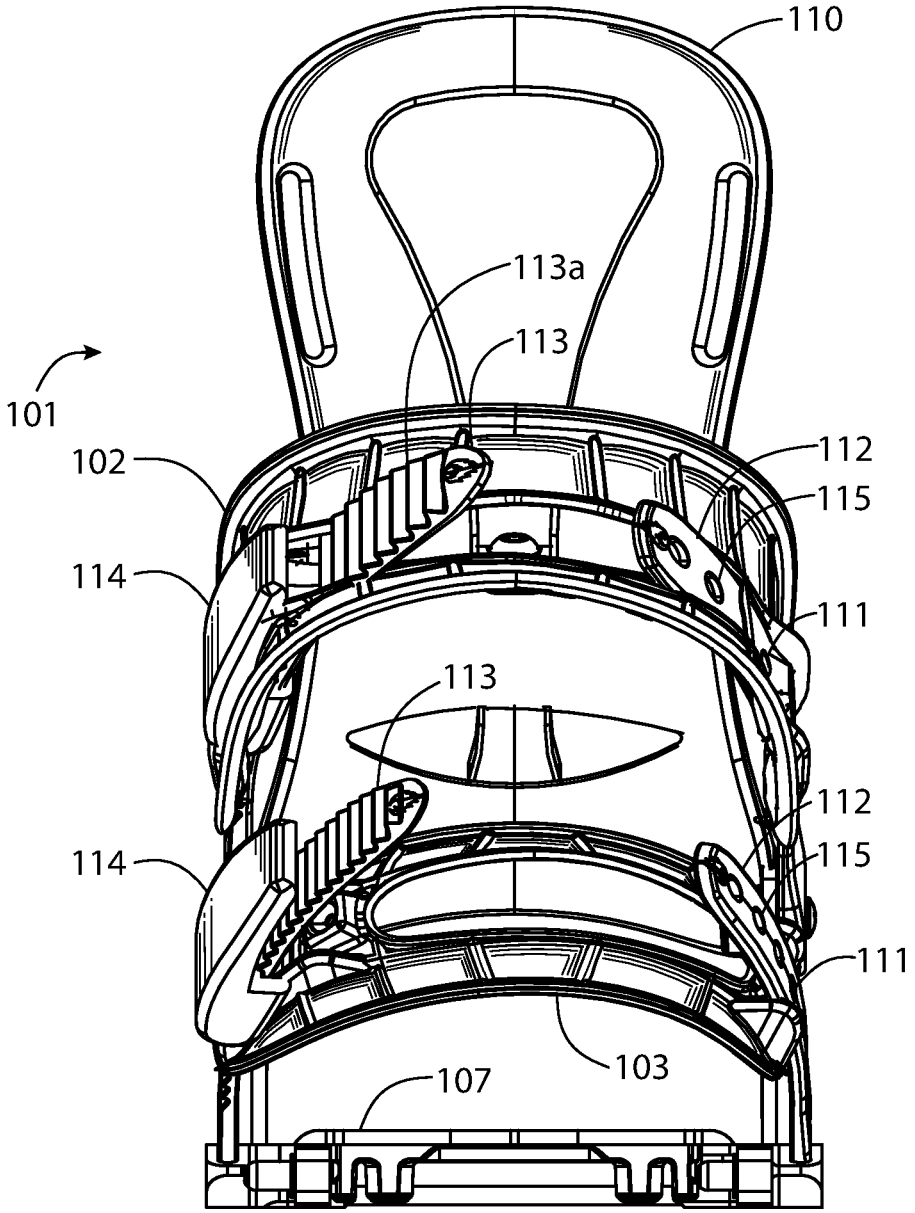
FIG. 3 illustrates a front elevation view of the boot binding of FIG. 2.
Figure 4:
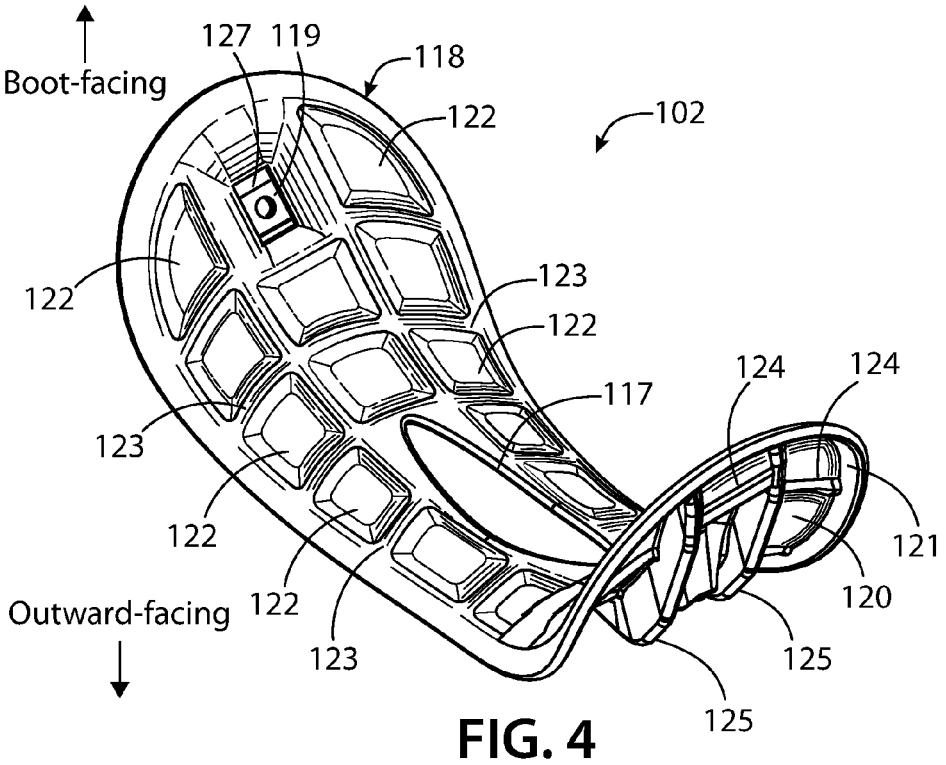
FIG. 4 illustrates a rear and top (i.e. boot-side) perspective view of an ankle strap of FIG. 2.

FIG. 2 illustrates a front and top perspective view of a boot binding 101 of FIG. 1 illustrating the ankle strap 102 and toe strap 103. FIG. 3 illustrates a front elevation view of the boot bindings 101 of FIG. 2. Referring to FIGS. 2 and 3, the ankle strap 102 and the toe strap 103 are shown in context with the other parts of the boot binding 101. The boot binding 101 illustrated includes a base plate 107, a heel cup 109 (FIG. 2), and a highback 110. Referring to FIGS. 1-3, the base plate 107 provides a stable base for the rider's boot and attaches the boot binding 101 to the splitboard 100 (FIG. 1). The base plate 107 attaches the boot binding 101 to splitboard 100 (FIG. 1) via the pucks 104 (FIG. 1) in riding mode or attaches to splitboard 100 (FIG. 1) via the toe pivot 105 (FIG. 1) and heel block 106 (FIG. 1) in touring mode. The highback 110 (FIGS. 2 and 3) and heel cup 109 (FIG. 2) help transfer energy from the back of the leg and body to the splitboard 100 (FIG. 1). When you lean on the highback it causes the heel side edge of the board to dig into the snow, and a heel side turn is made. Referring to FIG. 2, the heel cup 109 is shown rigidly secured to the base plate 107 via threaded fasteners 111. The heel cup 109, in turn, couples the highback 110 to the base plate 107. The threaded fasteners for securing the heel cup 109 to the base plate 107 are illustrated as button head hex machine screws. However, other threaded fasteners with similar holding characteristics able to reasonably withstand the normal forces encountered when operating a splitboard or snowboard can be readily substituted.

Referring to FIGS. 2 and 3, a length adjuster strap 112 secures the ankle strap 102 to the heel cup 109 (FIG. 2) on one side of the ankle strap 102. A combination of a ladder strap 113 and ratcheting buckle 114 secures the ankle strap 102 on the heel cup 109 on the opposing side. The ratcheting buckle 114 is secured to the ankle strap by a threaded faster (hidden from view in FIGS. 2 and 3). The surface of the ladder strap 113, is constructed, as is known in the art for ladder straps, with a stepped surface 113*a* shaped to engage and be held securely under tension by the ratcheting buckle 114. Referring to FIG. 2, the ladder strap 113 is secured to the heel cup 109 by threaded fastener 111, illustrated as a Phillips head machine screw. However, the threaded fastener 111 can be any threaded fastener 111 that can reasonably secure the ladder strap 113 under the forces encountered during the normal operation of the splitboard 100 (FIG. 1). Referring to FIG. 3, the length adjuster strap 112 is illustrated including two length-wise (i.e. longitudinal) parallel sides along and a series of apertures 115 positioned along the length-wise centerline. Referring to the upper right-hand side of FIG. 3, the length adjuster strap 112 is secured to the ankle strap 102 by a threaded fastener 111.

Referring back to FIGS. 2 and 3, similarly, as described in the previous paragraph, a length adjuster strap 112 secures the toe strap 103 to the base plate 107 (FIG. 2) on one side of the toe strap 103. A combination of a ladder strap 113 and ratcheting buckle 114 secures the toe strap 103 on the base plate 107 on the opposing side. The ratcheting buckle 114 is secured to the toe strap by a threaded faster (hidden from view in FIGS. 2 and 3). The surface of the ladder strap 113, is constructed, as previously described. In FIG. 2, the ladder strap 113 is shown, in the lower left-hand side of the illustration secured to the base by a pivot pin 116 molded into the ladder strap 113. The length adjuster strap 112 is illustrated, as previously described, with a series of apertures 115 (FIG. 3) positioned along the length-wise centerline. Referring to the lower right-hand side of FIG. 3, the length adjuster strap 112 is secured to the toe strap 103 by a threaded fastener 111.

Referring to FIG. 2, the combination of the base plate 107 and the heel cup 109 form a rigid structure that transfers force directly to the splitboard 100 (FIG. 1). As previously discussed, the heel cup 109 and the highback 110 transfers force from the rider's body to the splitboard 100 (FIG. 1) through the boot binding 101. The toe strap 103 and more particularly the ankle strap 102 also transfer force from the rider's body to the splitboard 100 (FIG. 1). The inventor observed that the stiffness of the ankle strap 102 and to some degree, the toe strap 103 can affect the ride. An ankle strap 102 or toe strap 103 that is flexible generally allows quicker maneuvering than an ankle strap 102 or toe strap 103 that is stiff. An ankle strap 102 that is flexible can allow the splitboard to respond to subtle movements of the rider's knees and ankle. The rider can use particular body movements to steer the splitboard 100 (FIG. 1). An ankle strap 102 that is stiff, on the other hand, reflects movement directly to the heel cup 109 and base plate 107 as a single rigid, or semi-rigid, member to the splitboard 100 (FIG. 1). An ankle strap 102 that is stiff will generally respond to any body movement, rather than a particular body movement. An ankle strap 102 that is flexible is well suited to downhill slopes with trees and other obstacles. An ankle strap 102 that is stiff is better suited to open terrain where speed is more important than maneuverability.

The inventor set out to make an ankle strap 102 and a toe strap 103 that was easier to manufacture and more durable than typical ankle and toe straps that exist in the market. FIGS. 4-13 illustrate the ankle strap 102 of FIGS. 1-3 in various views. FIGS. 14-22 illustrate an ankle strap 202 similar to the ankle strap 102 of FIGS. 4-13 with the main difference being a central aperture 117 illustrated in FIGS. 4-8, 11 and 13 that is not present in ankle strap 202. The ankle strap 202 is also larger and covers more of the boot. It constrains movement more than ankle strap 102, and transfers more force to the binding 101 and splitboard 100. This central aperture 117 makes the ankle strap 102 more flexible over the top of the boot. FIGS. 23-32 illustrate the toe strap 103 of FIGS. 1-3. The toe strap 103 includes a central aperture 117 as illustrated in FIGS. 23-27. The purpose of the central aperture 117 is different than for the ankle strap 102. As the toe of the rider's boot is doubly convex, the central aperture 117 helps to keep the toe strap 103 in place at the toe of the boot and prevent the strap from slipping onto the top of the rider's boot.

The ankle strap 102 (FIGS. 4-13), the ankle strap 202 (FIGS. 14-22), and the toe strap 103 (FIGS. 23-32), the ankle strap 302 (FIGS. 33-36), the ankle strap 402 (FIGS. 37-40), and the ankle strap 502 (FIGS. 41-44) all share common features conceived by the inventor. Referring to FIGS. 4-44, the inventor created an ankle strap 102 (FIGS. 4-13), ankle strap 202 (FIGS. 14-22), or toe strap 103 (FIGS. 23-32), the ankle strap 302 (FIGS. 33-36), the ankle strap 402 (FIGS. 37-40), and the ankle strap 502 (FIGS. 41-44) that includes a one-piece molding 118 and a pair of threaded inserts 119 (FIGS. 4-8, 12-18, 22-27, 31, and 32-44). The one-piece molding 118 can be made of materials with flexibility, ductility, and temperature stability consistent with the rigors of the harsh conditions, stress, and wide temperature range encountered when splitboarding and snowboarding. For example, snowboards and splitboards typically operate between 0° C. (32° F.) to −40° C. (−40° F.). It would be desirable for the one-piece molding to have consistent mechanical and elastic properties across these temperature ranges. Such materials include thermal plastic elastomers (TPE). One such TPE is manufactured by Dupont and sold under the brand name HYTREL®. Another class of materials suitable for the one-piece molding is Thermal Plastic Olien (TPO). TPE and TPO are both blends of thermoplastic, elastomer, and fillers.

Referring to FIGS. 4, 5, 7, 8, 10, 11, 12, 14, 15, 17, 18, 20, 21, 24, 26, 27-29, 31, and 32-34, 36-38, 40-42, and 44, the one-piece molding 118 includes a series of indented portions 120 on the outward-facing side of the one-piece molding 118. These indented portions 120 create a series of corresponding outdented portions 122 on the boot-facing surface 123 of the one-piece molding 118. The outdented portions 122 on the boot-facing surface 123 of the one-piece molding 118 are illustrated in FIGS. 4, 5, 6, 9-16, 19-21, 23, 25, and 29-35, 37-39, 41-43. The outdented portions 122 flex when pressed against the surface of the rider's boot and act as cushioning while riding downhill or touring through the backcountry.

Referring to FIGS. 4, 5, 7, 8, 10, 11, 12, 14, 15, 17, 18, 20, 21, 24, 26, and 27-29, 33, 34, 36-38, 40-42, and 44, the area between the indented portions 120 on the outward-facing side of the one-piece molding 118 includes a perimeter rib 121, and non-perimeter ribs. The non-perimeter ribs include lateral ribs 124, and length-wise ribs 125. The perimeter rib 121 runs continuously around the perimeter of the one-piece molding 118. The perimeter rib 121 and the non-perimeter ribs (i.e. the length-wise ribs 125 and lateral ribs 124) form a continuous interconnected ribbed structure. The one-piece molding is molded into a semi-rigid arc-like (i.e. arcuate shape) without the aid of ribbing in part because of the shape of the mold and the material used in the one-piece molding. The length-wise ribs 125 add sufficient stiffness to help further hold the one-piece molding 118 in the arcuate shape while still being of the height and width along at least the mid-portion of the length to allow for flexing during use. The arcuate shape is illustrated in FIGS. 4, 5, 9-11, 13-15, 19-21, 23, 24, 27-30, 33, 34, 36, 37, 41, and 42. As illustrated in FIGS. 5, 15, 24, 28, 38, and 42, the length-wise ribs 125 are taller (i.e. thicker) near both length-wise ends of the strap. The arcuate shape approximates the outside radius of a typical snow boot where the strap contacts the boot. For the ankle strap 102, ankle strap 202, ankle strap 302, ankle strap 402, ankle strap 502, this would be the upper radius of the snow boot. For the toe strap 103 this would approximate the radius at the end of the foot. Referring to FIGS. 4, 5, 8, 10, 11, 13-15, 17, 18, 20, 21, 24, and 26-28, 33, 34, 36-38, 40-42, and 44 the lateral ribs 124 add structure and stiffness around the indented portions 120. The resulting structure allows the softer body of the ankle strap 102 (FIGS. 4, 5, and 9), ankle strap 202 (FIGS. 14, 15, and 19), ankle strap 302 (FIGS. 33, 34), ankle strap 402 (FIGS. 37, 38), ankle strap 502 (FIGS. 40, 41) or toe strap 103 (FIGS. 23, 24, and 28) to conform to the top and sides near the top of the boot while the ends of the ankle strap 102, ankle strap 202, ankle strap 302, ankle strap 402, ankle strap 502, or toe strap 103, with attachments such as the ratcheting buckles 114 (FIGS. 2 and 3), are held away from the boot.

Figure 10:
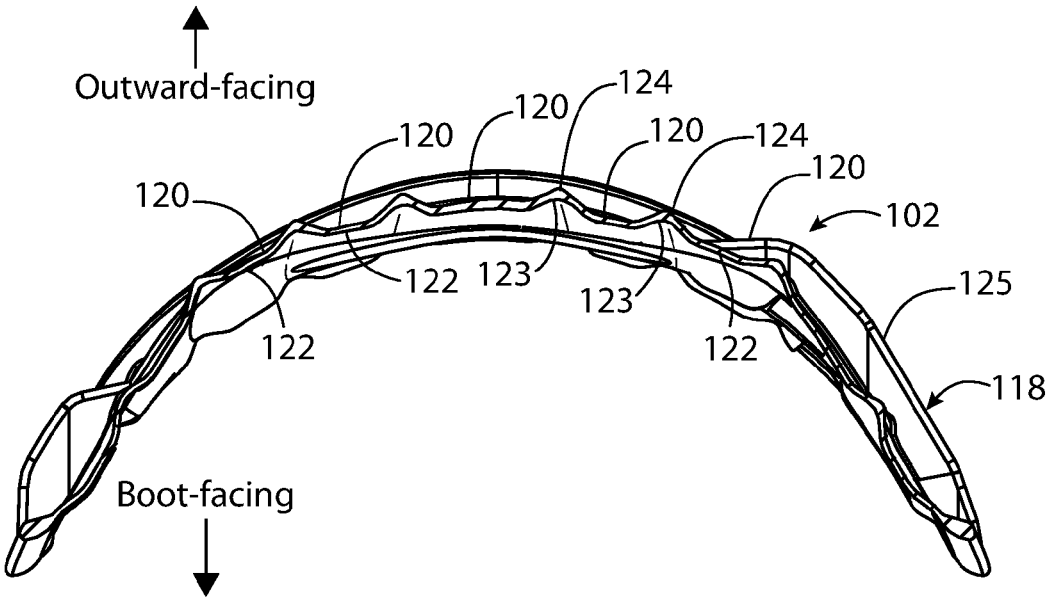
FIG. 10 illustrates a section view of an ankle strap of FIG. 6 taken along section lines 10-10.
Figure 11:
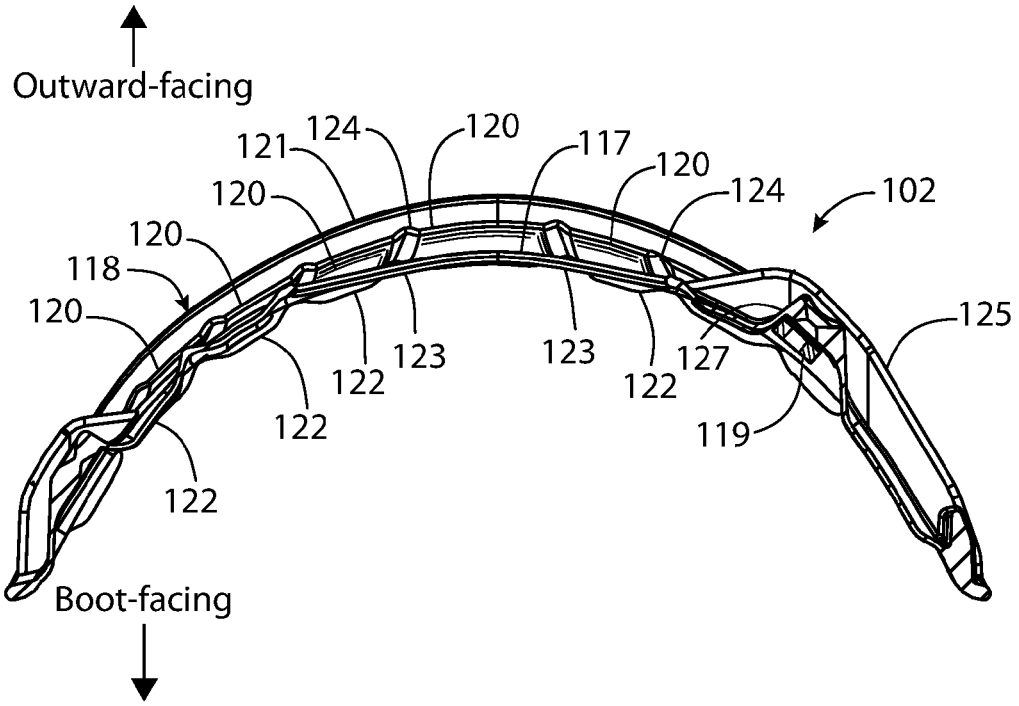
FIG. 11 illustrates a section view of an ankle strap of FIG. 7 taken along section lines 11-11.
Figure 12:
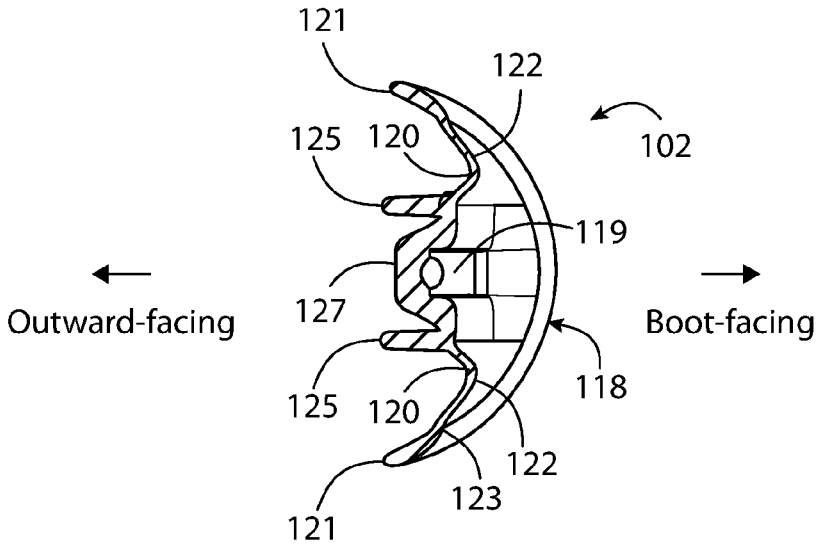
FIG. 12 illustrates a section view of an ankle strap of FIG. 9 taken along section lines 12-12.
Figure 20:
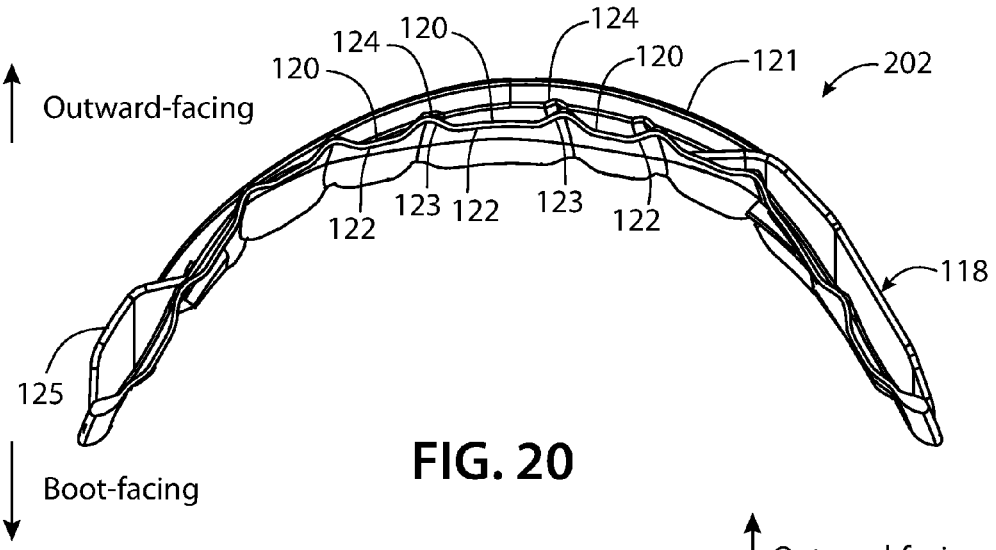
FIG. 20 illustrates a section view of an ankle strap of FIG. 16 taken along section lines 20-20.
Figure 21:
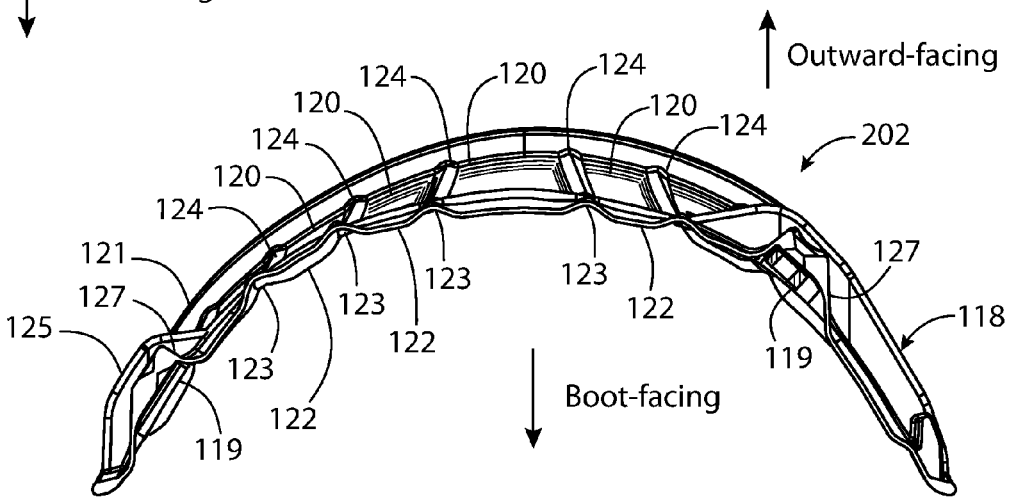
FIG. 21 illustrates a section view of an ankle strap of FIG. 17 taken along section lines 21-21.
Figure 22:
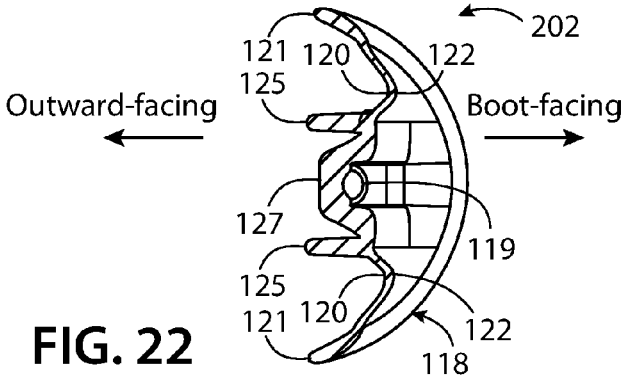
FIG. 22 illustrates a section view of an ankle strap of FIG. 19 taken along section lines 22-22.
Figure 23:
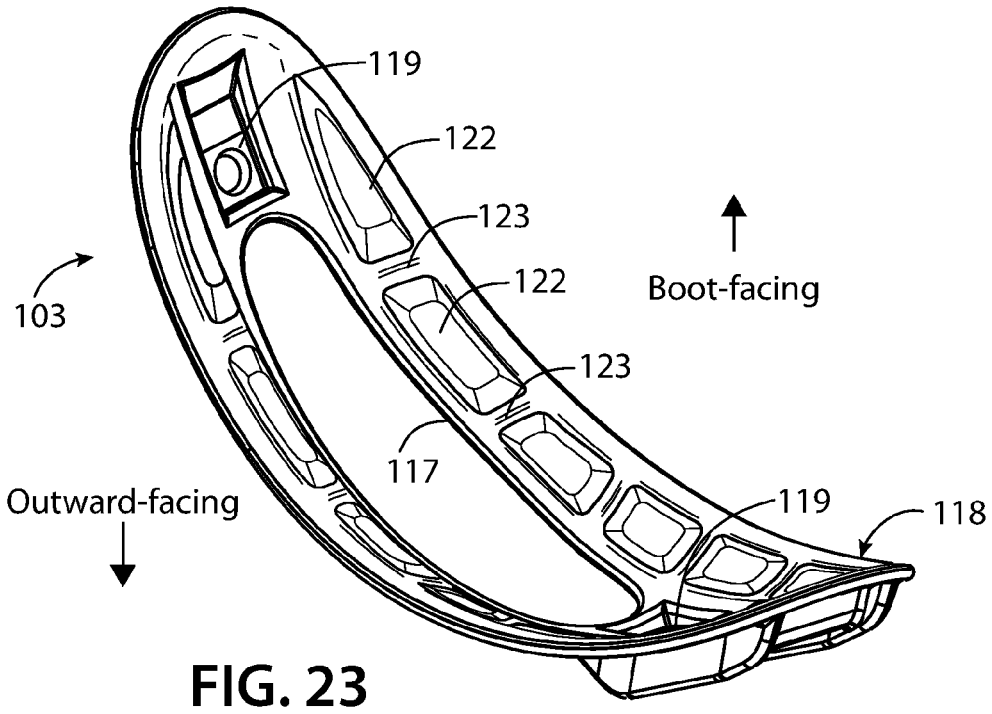
FIG. 23 illustrates a bottom and rear (i.e. boot-side) perspective view of a toe strap of the present disclosure.
Figure 29:
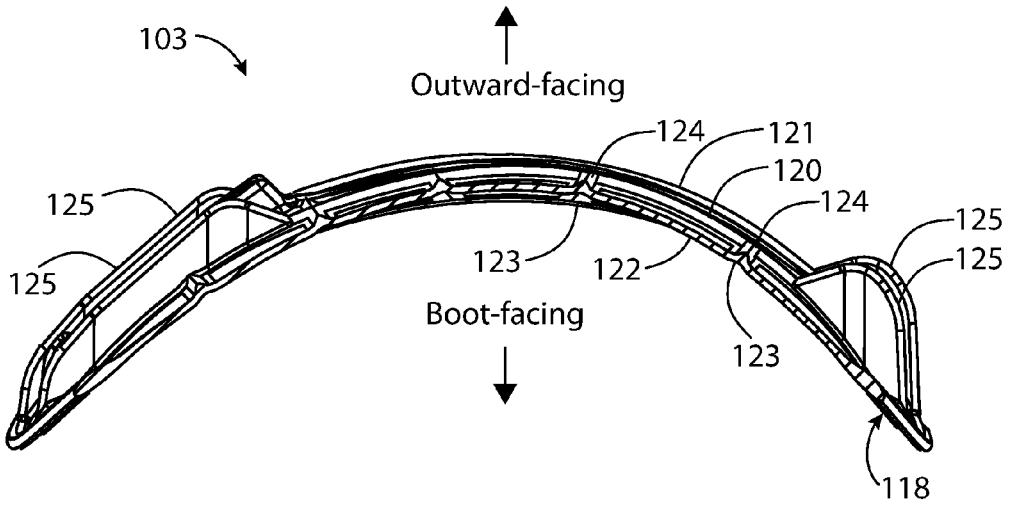
FIG. 29 illustrates a section view of the toe strap of FIG. 27 taken along section lines 29-29.
Figure 30:
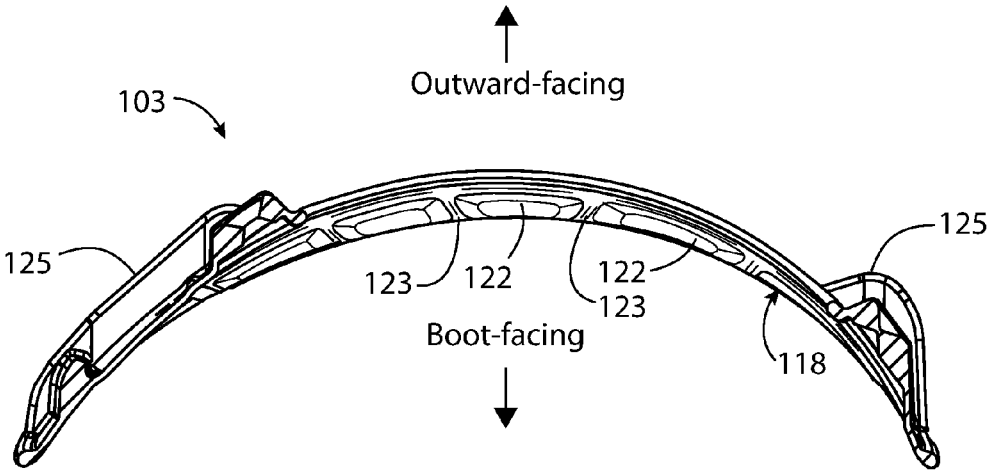
FIG. 30 illustrates a section view of the toe strap of FIG. 25 taken along section lines 30-30.
Figure 31:
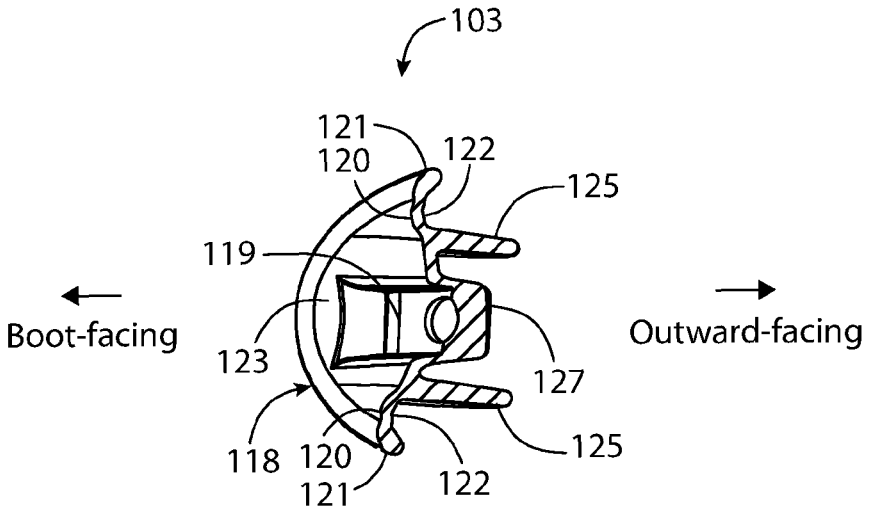
FIG. 31 illustrates a section view of the toe strap of FIG. 28 taken along section lines 31-31.
Figure 32:
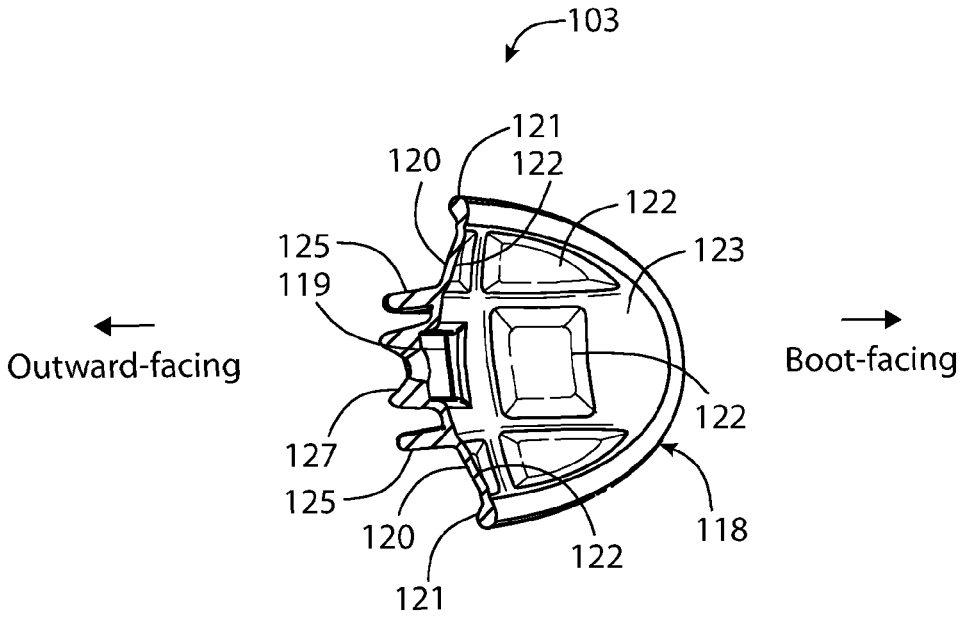
FIG. 32 illustrates a section view of the toe strap of FIG. 28 taken along section lines 32-32.
Figure 33:
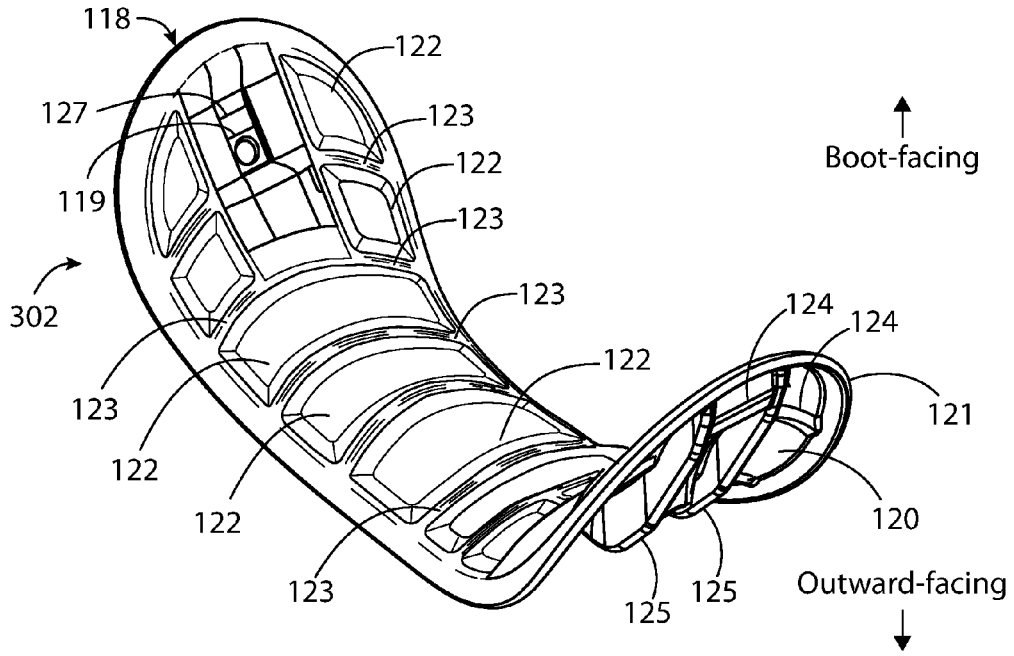
FIG. 33 illustrates a rear and top (i.e. boot-side) perspective view of an ankle strap with an alternative ribbing pattern.
Figure 34:
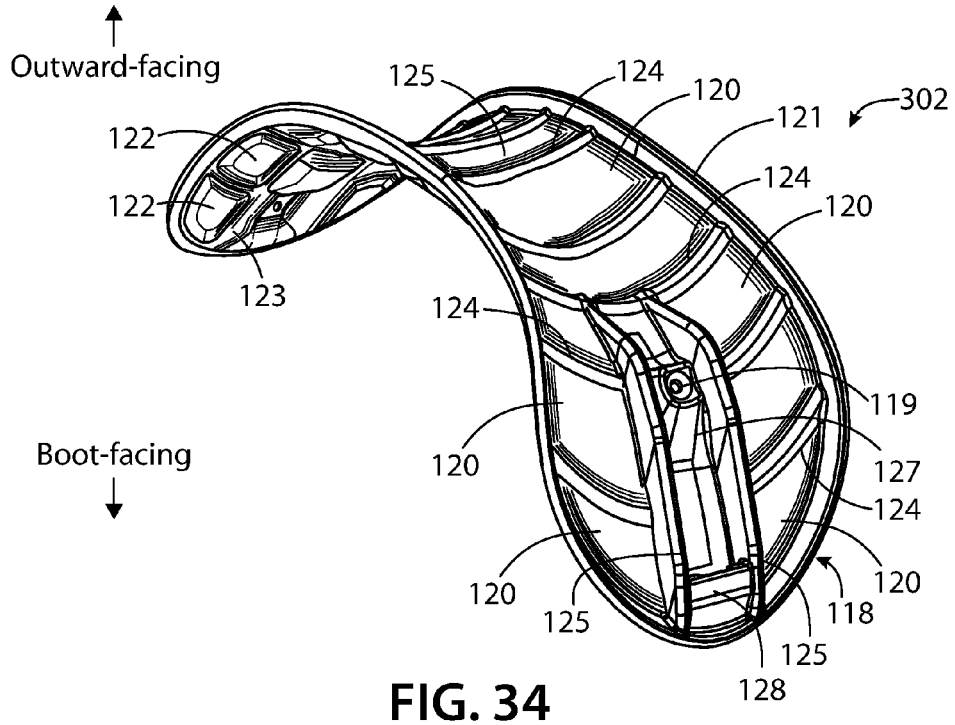
FIG. 34 illustrates a front bottom perspective view (i.e. outward-facing) perspective view of an ankle strap of FIG. 33.
Figure 35:
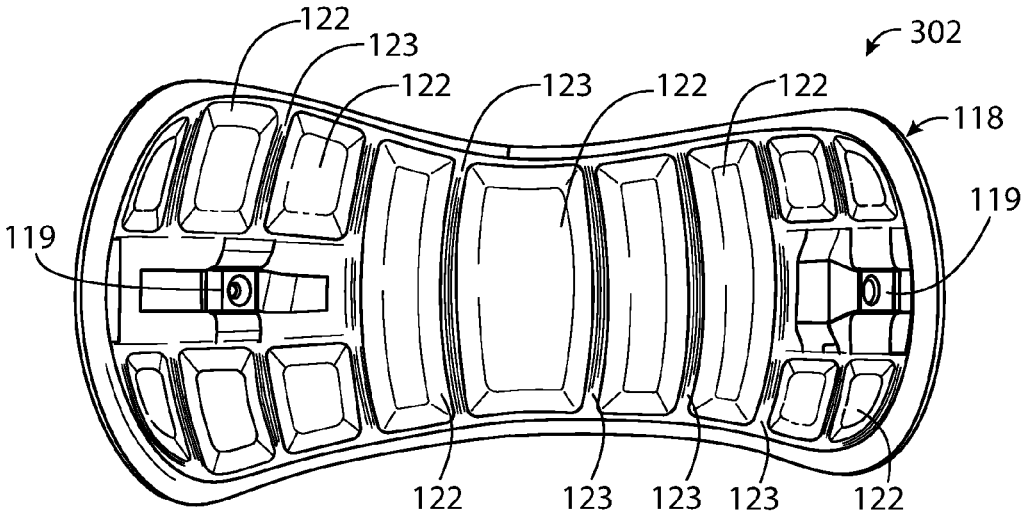
FIG. 35 illustrates a rear (i.e. boot-side) elevation view of an ankle strap of FIG. 33.

The relationship between the indented portions 120, the perimeter rib 121, the outdented portions 122, the boot-facing surface 123, the lateral ribs 124, is illustrated in the length-wise sectional views for the ankle strap 102 in FIGS. 10 and 11, the ankle strap 202 in FIGS. 20 and 21, and the toe strap 103 in FIG. 29. In these figures, the boot-facing surface 123 forms a channel or a surface minima between the outdented portions 122. The lateral ribs 124 are directly aligned over the boot-facing surface 123 between the outdented portions 122. The outdented portions 122 are directly aligned under the indented portions 120. The outdented portions 122 are a result of the surface indentation on the outward-facing surface.

The lateral boundaries of the indented portion 120 are the lateral ribs 124. The corresponding lateral boundaries of the outdented surface is the boot-facing surface 123 aligned directly under the lateral ribs 124. As illustrated in FIGS. 12, 22, 31, and 32, indented portions 120 can be bound length-wise by the perimeter rib 121 and the length-wise ribs 125. Corresponding outdented portions 122 would be bound by portions of the boot-facing surface directly under the perimeter rib 121 and the length-wise ribs 125. Alternatively, indented portions 120 can be bound length-wise by length-wise ribs 125 on both sides as illustrated for the indented portions along the centerline in FIGS. 7 and 17. Corresponding outdented portions 122 would be bound by portions of the boot-facing surface directly under the length-wise ribs 125.

Figure 7:
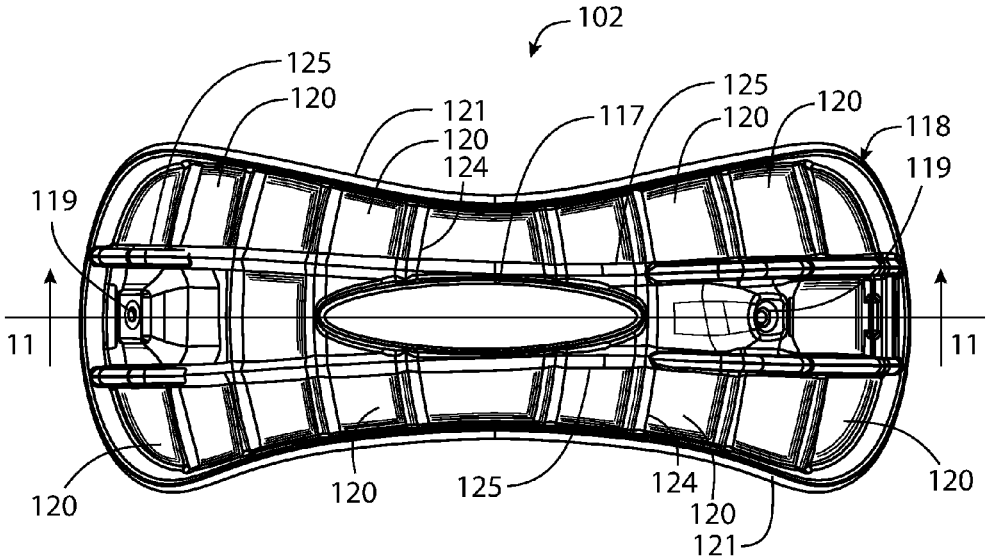
FIG. 7 illustrates a front (i.e. outward-facing) elevation view of an ankle strap of FIG. 4.
Figure 8:
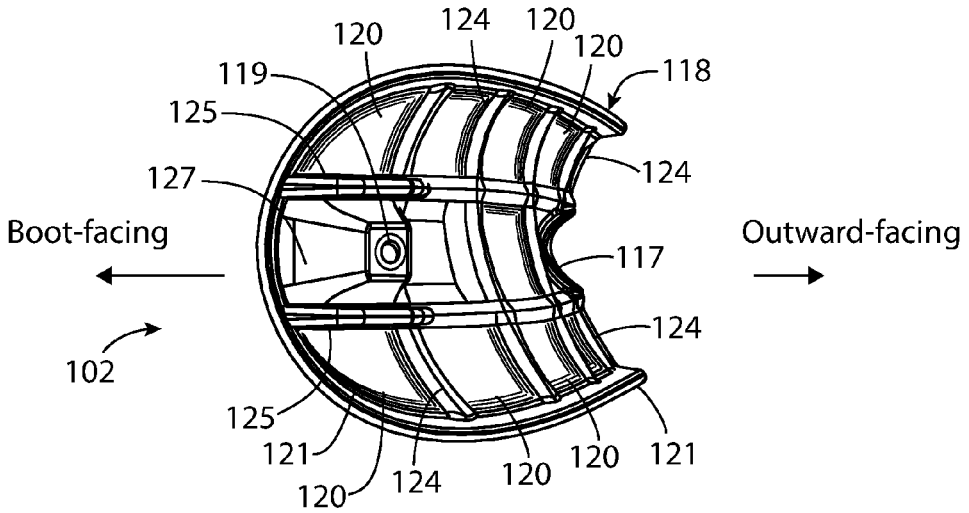
FIG. 8 illustrates a right elevation view of an ankle strap of FIG. 4.
Figure 9:
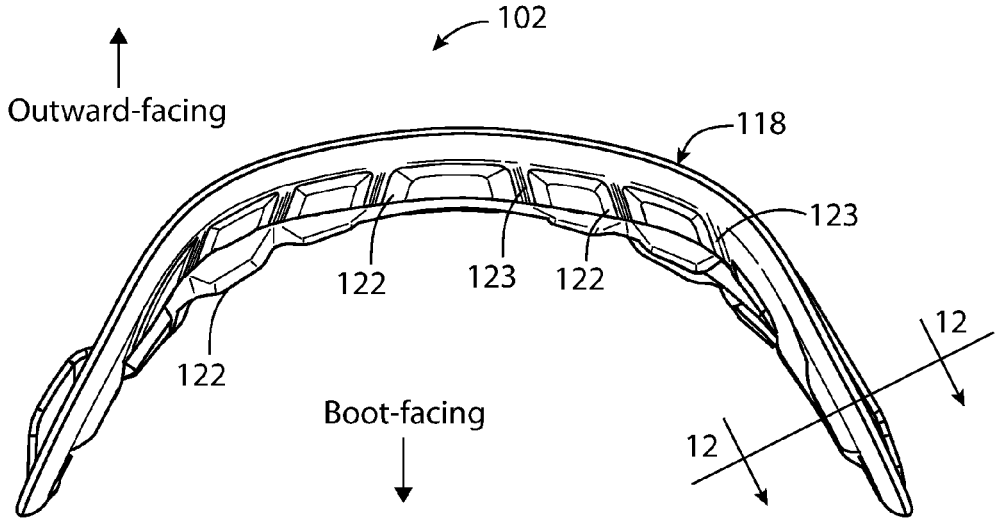
FIG. 9 illustrates a bottom plan view of an ankle strap of FIG. 4.
Figure 17:
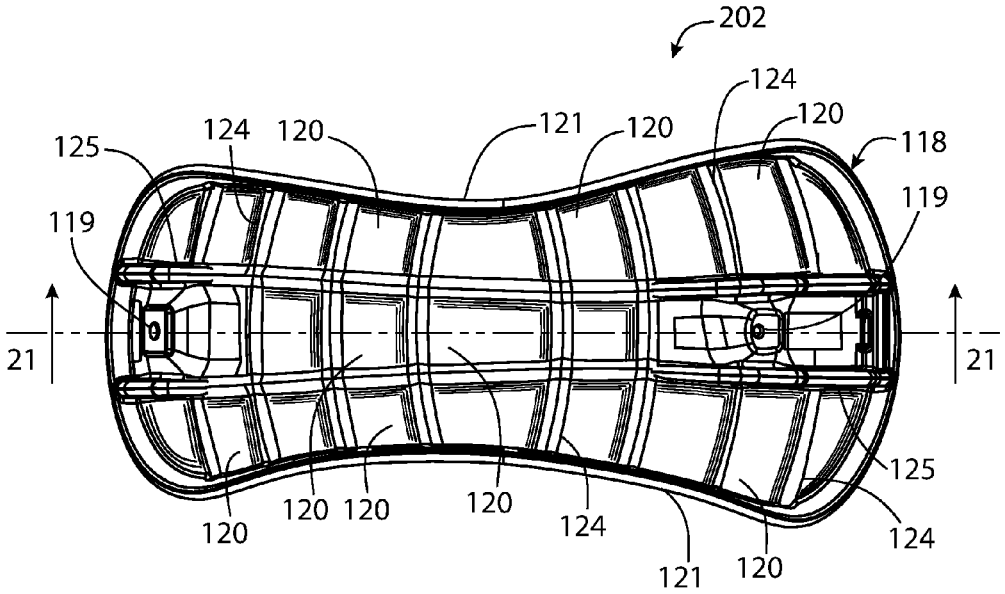
FIG. 17 illustrates a front (i.e. outward-facing) elevation view of an ankle strap of FIG. 14.
Figure 18:
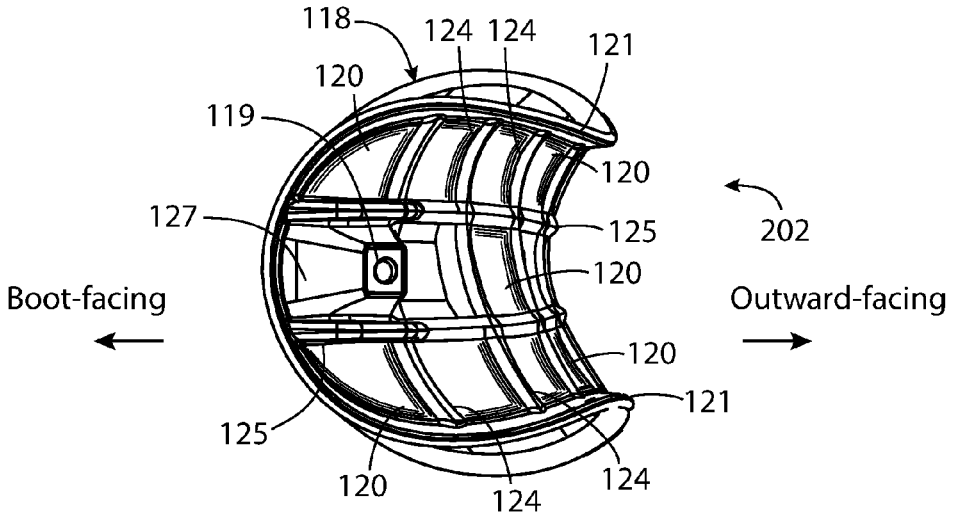
FIG. 18 illustrates a right and side elevation view of an ankle strap of FIG. 14.
Figure 19:
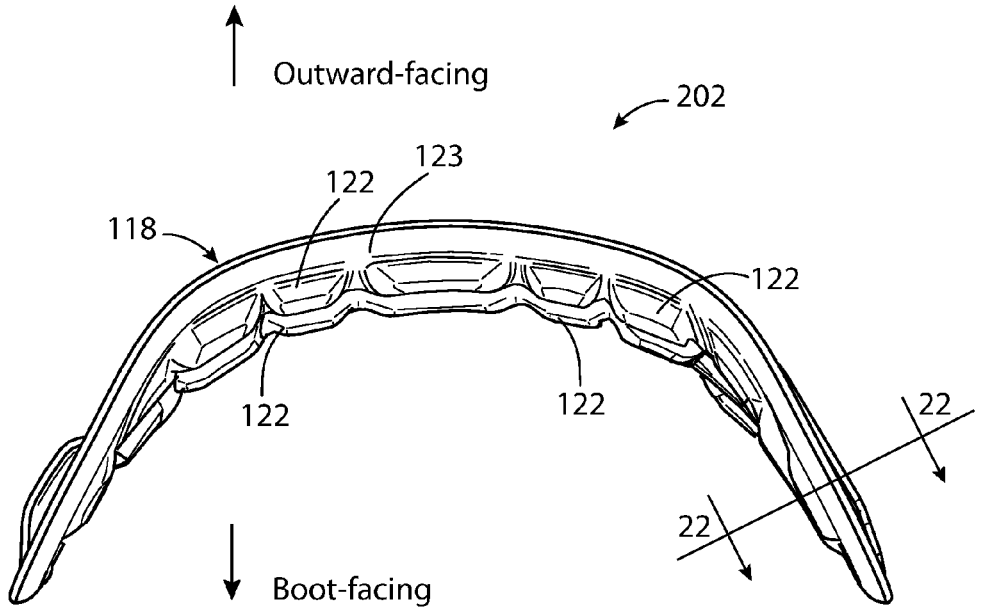
FIG. 19 illustrates a bottom plan view of an ankle strap of FIG. 14.
Figure 27:
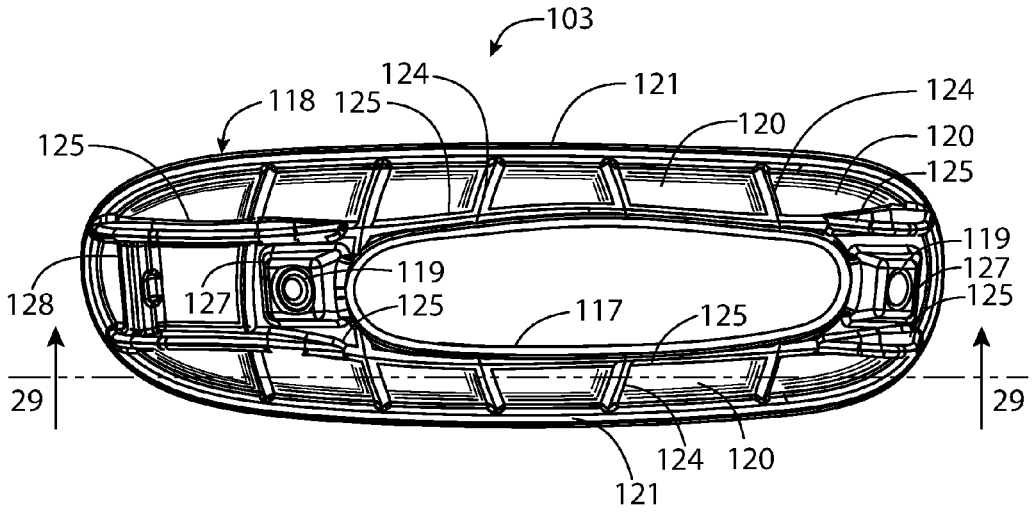
FIG. 27 illustrates a front (i.e. outward-facing) elevation view of the toe strap of FIG. 23.
Figure 28:
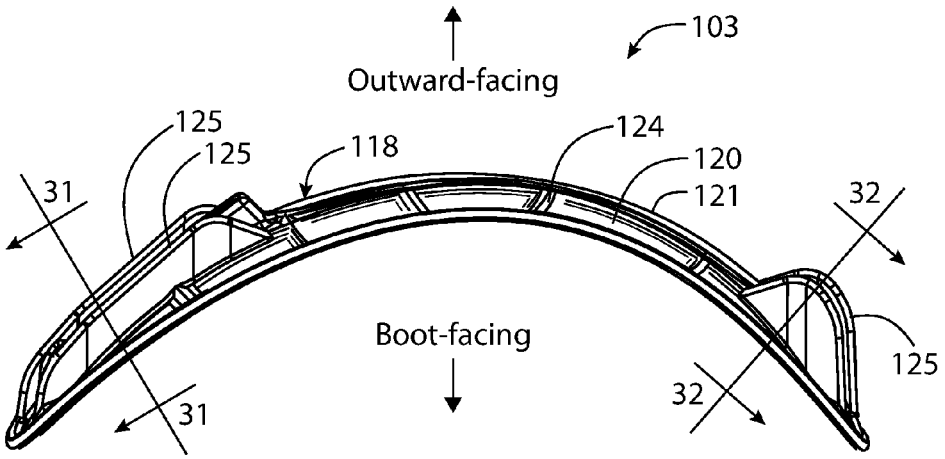
FIG. 28 illustrates a bottom plan view of the toe strap of FIG. 23.
Figure 36:
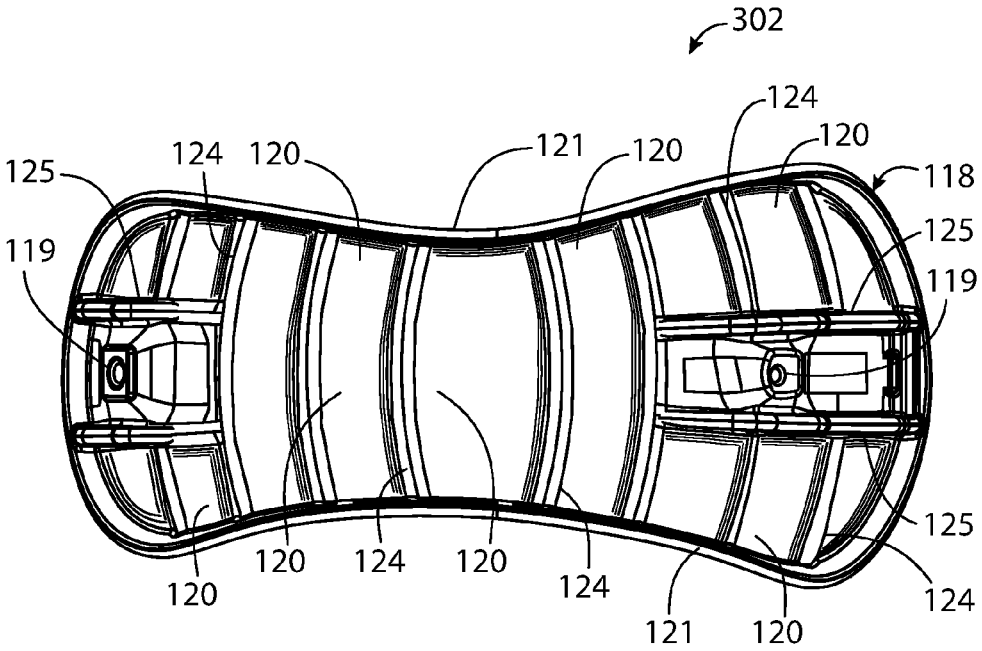
FIG. 36 illustrates a front (i.e. outward-facing) elevation view of an ankle strap of FIG. 33.
Figure 37:
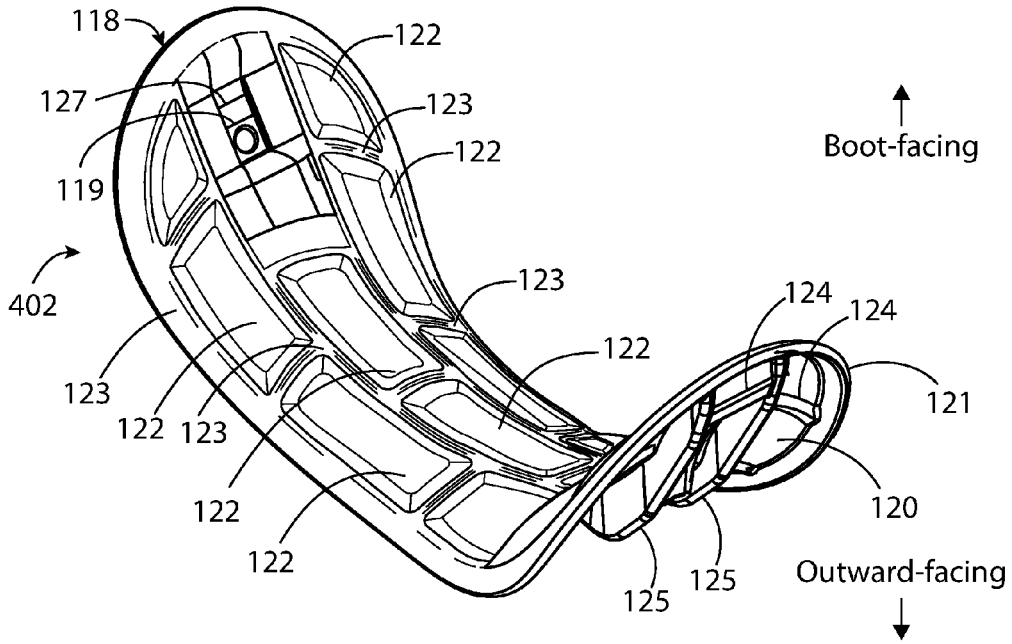
FIG. 37 illustrates a rear and top (i.e. boot-side) perspective view of an ankle strap with a second alternative ribbing pattern.
Figure 38:
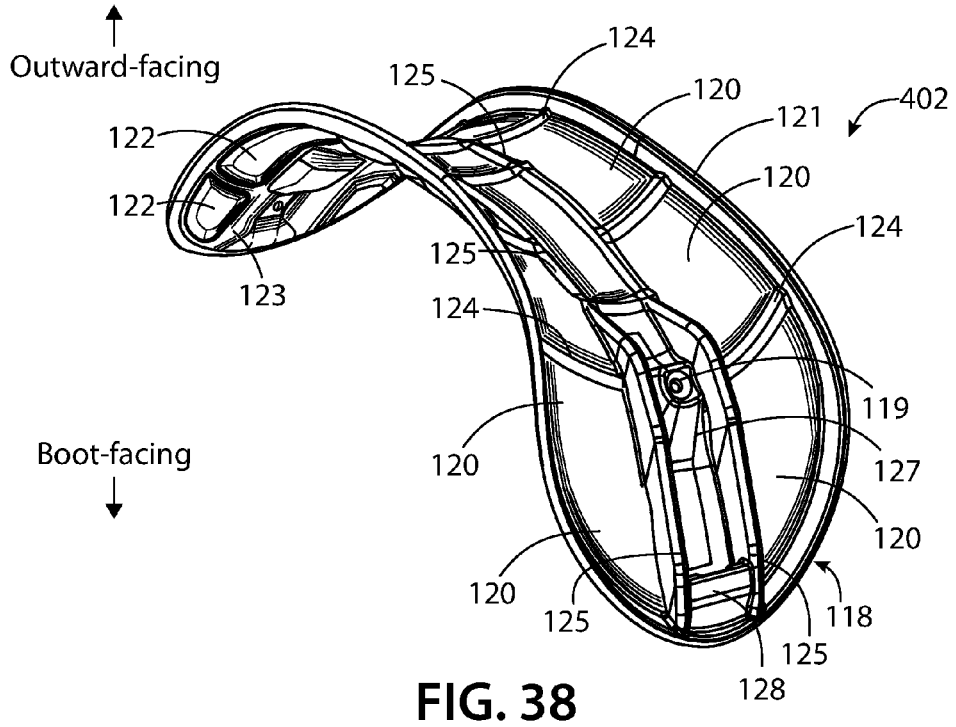
FIG. 38 illustrates a front bottom perspective view (i.e. outward-facing) perspective view of an ankle strap of FIG. 37.
Figure 39:
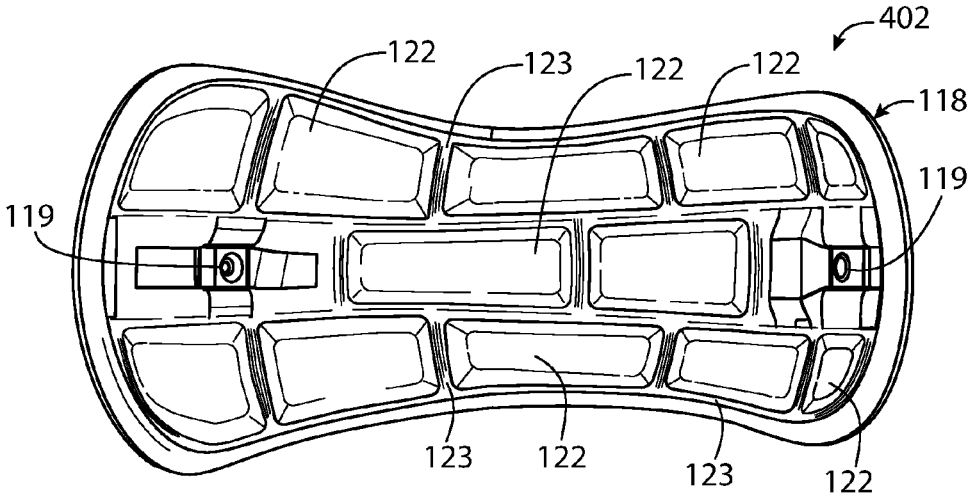
FIG. 39 illustrates a rear (i.e. boot-side) elevation view of an ankle strap of FIG. 37.
Figure 40:
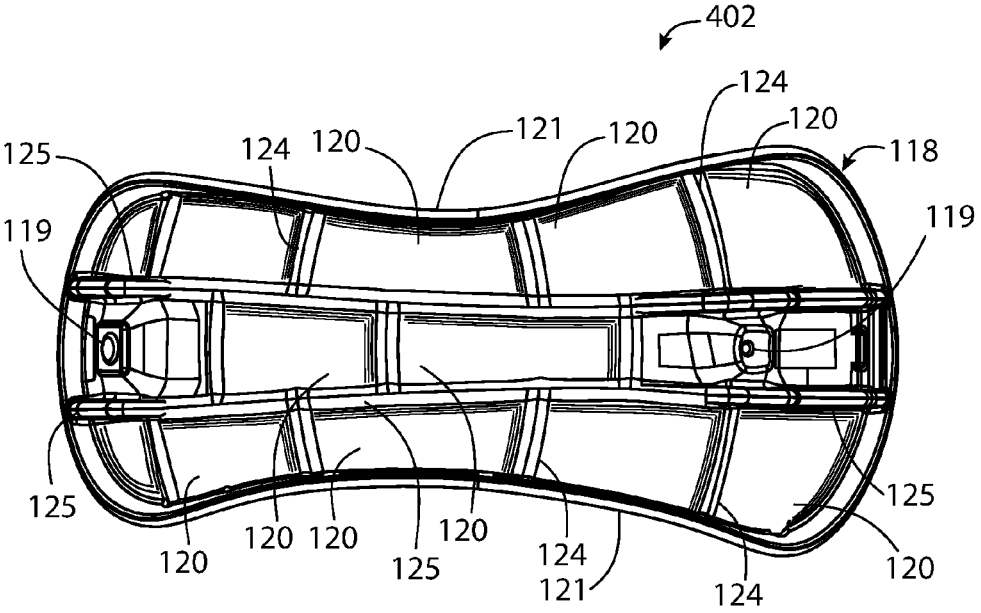
FIG. 40 illustrates a front (i.e. outward-facing) elevation view of an ankle strap of FIG. 37.
Figure 41:
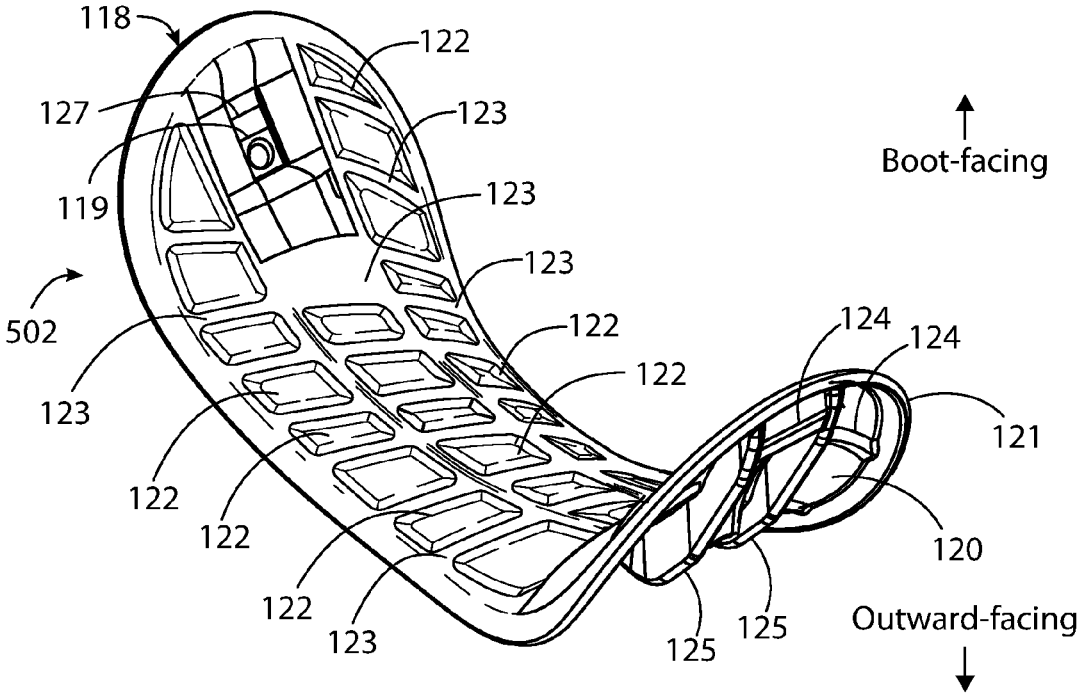
FIG. 41 illustrates a rear and top (i.e. boot-side) perspective view of an ankle strap with a third alternative ribbing pattern.
Figure 42:
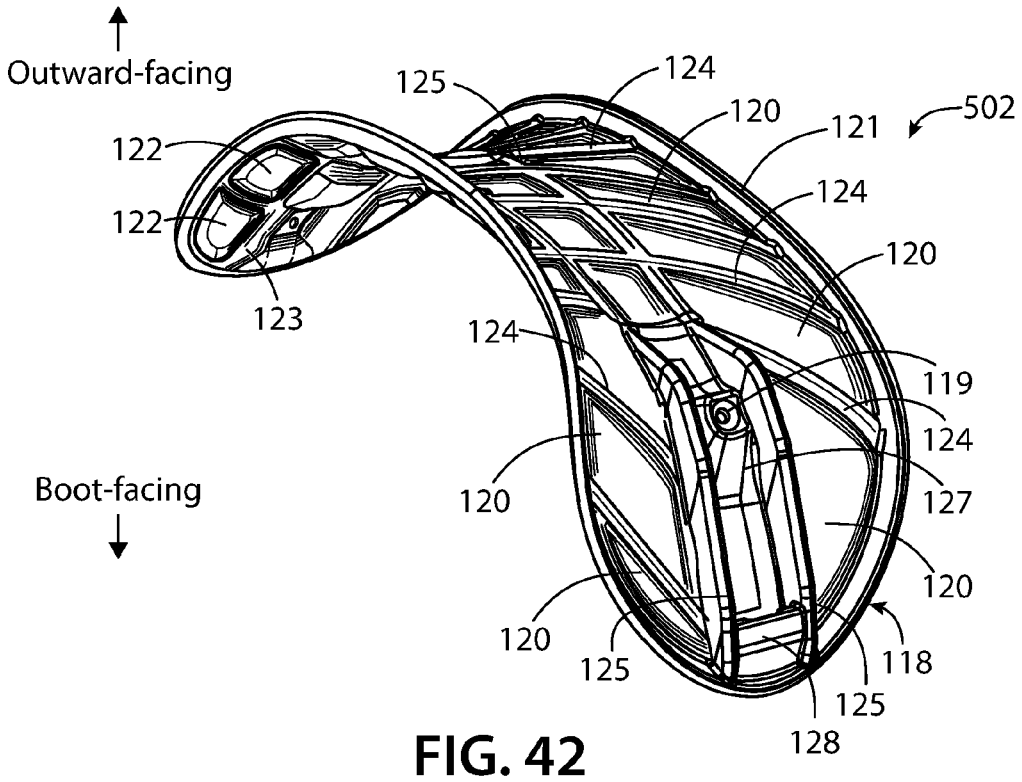
FIG. 42 illustrates a front bottom perspective view (i.e. outward-facing) perspective view of an ankle strap of FIG. 41.
Figure 43:
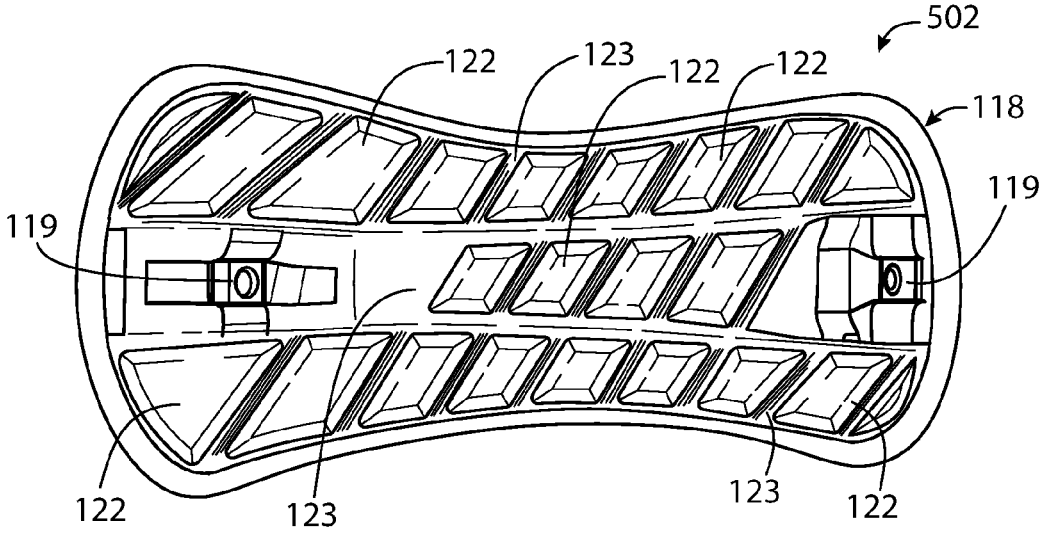
FIG. 43 illustrates a rear (i.e. boot-side) elevation view of an ankle strap of FIG. 41.
Figure 44:
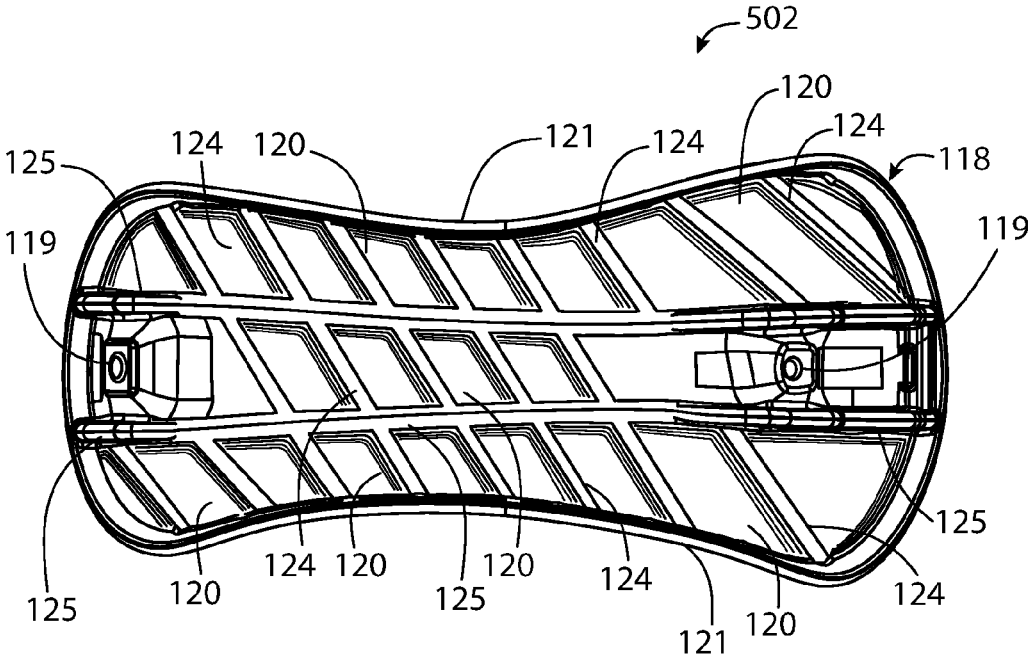
FIG. 44 illustrates a front (i.e. outward-facing) elevation view of an ankle strap of FIG. 41.

The relationship between the lateral and length-wise boundaries of the indented portions 120 and the outdented portions 122 can also be understood for the ankle strap 102 by viewing the rear view (i.e. boot-side view) and corresponding front view (i.e. outward-facing view) as a pair for each of the ankle strap 102, ankle strap 202, ankle strap 302, ankle strap 402, ankle strap 502, and toe strap 103. For the ankle strap 102, FIG. 6, which is a rear (i.e. boot-side view) elevation view, shows the boot-facing surface 123 as the boundary surrounding the outdented portions 122. FIG. 7, which is a front (i.e. outward-facing) elevation view, shows the corresponding perimeter rib 121 and length-wise ribs 125 creating length-wise boundaries and the lateral ribs 124 creating lateral boundaries. For the ankle strap 202, FIG. 16, which is a rear (i.e. boot-side view) elevation view, shows the boot-facing surface 123 as the boundary surrounding the outdented portions 122. FIG. 17, which is a front (i.e. outward-facing) elevation view, shows the corresponding perimeter rib 121 and length-wise ribs 125 creating length-wise boundaries and the lateral ribs 124 creating lateral boundaries. For the toe strap 103, FIG. 25, which is a rear elevation view, shows the boot-facing surface 123 as the boundary surrounding the outdented portions 122. FIG. 27, which is a front elevation view, shows the corresponding perimeter rib 121 and length-wise ribs 125 creating length-wise boundaries and the lateral ribs 124 creating lateral boundaries. For the ankle strap 302, FIG. 35, which is a rear (i.e. boot-side view) elevation view, shows the boot-facing surface 123 as the boundary surrounding the outdented portions 122. FIG. 36, which is a front (i.e. outward-facing) elevation view, shows the corresponding perimeter rib 121 and length-wise ribs 125 creating length-wise boundaries and the lateral ribs 124 creating lateral boundaries. For ankle strap 402, FIG. 39, which is a rear (i.e. boot-side view) elevation view, shows the boot-facing surface 123 as the boundary surrounding the outdented portions 122. FIG. 40, which is a front (i.e. outward-facing) elevation view, shows the corresponding perimeter rib 121 and length-wise ribs 125 creating length-wise boundaries and the lateral ribs 124 creating lateral boundaries. FIG. 43, which is a rear (i.e. boot-side view) elevation view, shows the boot-facing surface 123 as the boundary surrounding the outdented portions 122. FIG. 44, which is a front (i.e. outward-facing) elevation view, shows the corresponding perimeter rib 121 and length-wise ribs 125 creating length-wise boundaries and the lateral ribs 124 creating lateral boundaries.

The perimeter rib 121, the length-wise ribs 125, and the lateral ribs 124, are illustrated as forming a continuous interconnected ribbed structure without any gaps or breaks. Referring to FIGS. 7, 17, 27, 36, 40, and 44, the perimeter rib 121 and the non-perimeter ribs (i.e. the lateral ribs 124 and the length-wise ribs 125) are illustrated as forming a continuous interconnected ribbed structure without any gaps or breaks. This continuous interconnected ribbed structure provides a supporting structure of the ankle strap 102 (FIG. 7), ankle strap 202 (FIG. 17), ankle strap 302 (FIG. 36), ankle strap 402 (FIG. 40), ankle strap 502 (FIG. 44), and the toe strap 103 (FIG. 27). The length-wise portion of the perimeter rib 121 in combination with the length-wise ribs 125 provide continuous length-wise structural stability. The lateral ribs 124 in combination with the lateral portion of perimeter rib 121 provides lateral or width-wise structural stability. The combination of continuous and interconnected ribbing as illustrated with the perimeter rib 121 and non-perimeter ribs (i.e. lateral ribs 124 and length-wise ribs 125) helps the one-piece molding 118 maintain its structural integrity as the outdented portions 122 (FIGS. 6, 16, 25, 35, 39, and 43) flex when force is transferred from the rider's boot to the strap. Because the ribbed structure is continuous, it maintains its structural integrity independent of flexing of the outdented portions. One of the inventor's contributions to the art of splitboard and snowboard ankle and toe straps, is to provide both continuous structure with flexing members surrounded by a combination of perimeter ribs 121 and non-perimeter ribs or surrounded by only non-perimeter ribs. Here the non-perimeters ribs can be either lateral ribs 124 or length-wise ribs 125, or can be a combination of both lateral ribs 124 and length-wise ribs 125. The flexing members refer portions that portions of the one-piece molding 118 made up by the outdented portions 122 (FIGS. 6, 16, 25, 35, 39, and 43) and the indented portions 120 (FIGS. 7, 17, 27, 36, 40, and 44). One of the ways that the inventor discovered that he could achieve a structural support behind flexing members is to make the ribs taller (i.e. from surface to maximum extent from the surface) than the thickness of the flexing members and corresponding boot-facing surface 123 surrounding the flexing member (FIGS. 6, 16, 25, 35, 39, and 43). For example, in a typical pre-production unit build by the inventor, the thickness of the flexing members (i.e. the thickness between the surface of the indented portions 120 and the surface of the outdented portions 122) is 0.00102 meters (0.04 inches). The lateral ribs 124 and the central portion of the length-wise ribs 125 are 0.00178 meters (0.07 inches) tall (i.e. the height from the surface of boot-facing surface to the maximum extent of the rib from the surface, where the outward-facing surface is directly adjacent to the indented portions 120). The end portions of the length-wise ribs 125 are 0.00318 meters (0.125 inches) tall. The perimeter rib 121 is 0.00229 meters (0.09 inches) tall. All ribs are 0.00508 meters (0.2 inches) wide at the base. Note that these measurements are typical and are not meant in any way to limit the claimed invention. Conventional practice in the plastic injection molding industry teaches to make wall thicknesses (in this case height) as uniform as possible. Typically, it is recommended that the rib width should not exceed 60% of the nominal wall thickness. Failure to heed this recommendation can cause the plastic to sink on the surface behind the rib. The inventor recognized that by going against convention, he could combine both a skeletal structure and flexing members into a one-piece molding 118 such as illustrated in FIGS. 4-44. Normally sink holes, sink channels, and sink marks would create a problem in injection molded parts. Referring to FIGS. 6, 16, 25, 35, 39, 43, because the sink channels occur on the boot-facing surface 123 surrounding the outdented portions 122 they merely add to apparent height of the outdented portions 122 and actually help the structure achieve its function.

Referring to FIGS. 5, 15, 24, 34, 38, and 44 while the inventor set out to build ankle and toe straps that were more durable and easy to manufacture, the inventor discovered that by varying the height of the length-wise ribs 125 he could adjust the performance of the ankle strap 102, ankle strap 202, ankle strap 302, ankle strap 402, ankle strap 502, or toe strap 103. Referring to FIGS. 1-3, at the same time, he could maintain rigidity and structural integrity on the side of the straps for mounting and securing the ratcheting buckles 114 (FIGS. 2 and 3), and length adjuster straps 112 (FIGS. 2 and 3) and for transferring the forces encountered during splitboard or snowboard riding to the boot binding 101 (FIG. 1) and splitboard 100 (FIG. 1).

As illustrated in FIGS. 5, 15, and 24, 34, 38, and 44, the length-wise ribs 125 are highest close to the length-wise ends of the strap. Varying the height of continuous ribbing in an injection molded part, such as the one-piece molding 118 illustrated throughout this disclosure, goes against convention. In general, injection molding handbooks recommend against such practices because it would tend to cause uneven flow of the injection molded material.

The ankle strap 102, ankle strap 202, ankle strap 302, ankle strap 402, ankle strap 502, and the toe strap 103 include an insert support 127 projecting outwards from the outward-facing side of the one-piece molding 118 and located proximate to the one-piece molding's 118 length-wise ends as illustrated in FIGS. 4, 5, 8, 11, 12, 15, 18, 21, 22, 24, 26, 27, 31, 32, 33, 37, 38, 41, and 42. Referring to FIGS. 4, 11, 14, 21, 22, 31, 33, 37, and 41, the boot-facing surface 123 is indented into the insert support 127. This allows the threaded insert 119 to be mounted on the boot-side of the one-piece molding 118 and avoid contact with the rider's boot because the threaded insert 119 resides below the contact surface. Referring to FIGS. 5, 15, 24, 34, 38, and 42, the insert support 127 is shown positioned along the length-wise centered line between the length-wise ribs 125. The length-wise ribs 125 are higher, and therefore stiffer, on either side of the insert support 127, as compared with central region of the one-piece molding 118. This stiffens the region around the insert support 127 and further adds to its structural integrity. Note that in the ankle strap 302 of FIGS. 33-36, the length-wise rib 125 does not extend across the entire length of the one-piece molding 118. Instead, the pair of length-wise ribs 125 is broken into two pairs separate of length-wise ribs 125 with one of the pairs of length-wise ribs 125 positioned near one end of the one-piece molding 118 and the other pair of the length-wise ribs 125 positioned near the opposite end of the length-wise molding.

Figure 13:
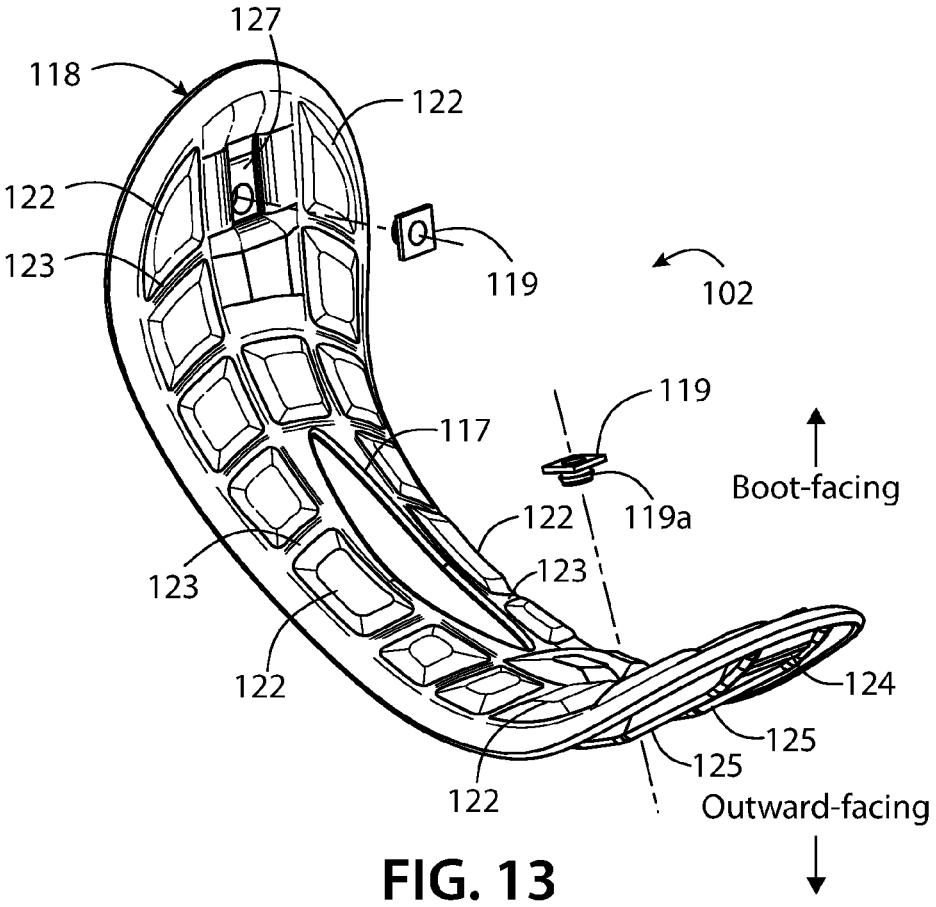
FIG. 13 illustrates a top and rear (i.e. boot-side) perspective view of the ankle strap of FIG. 4 showing threaded inserts exploded away from the molded ankle strap.
Figure 14:
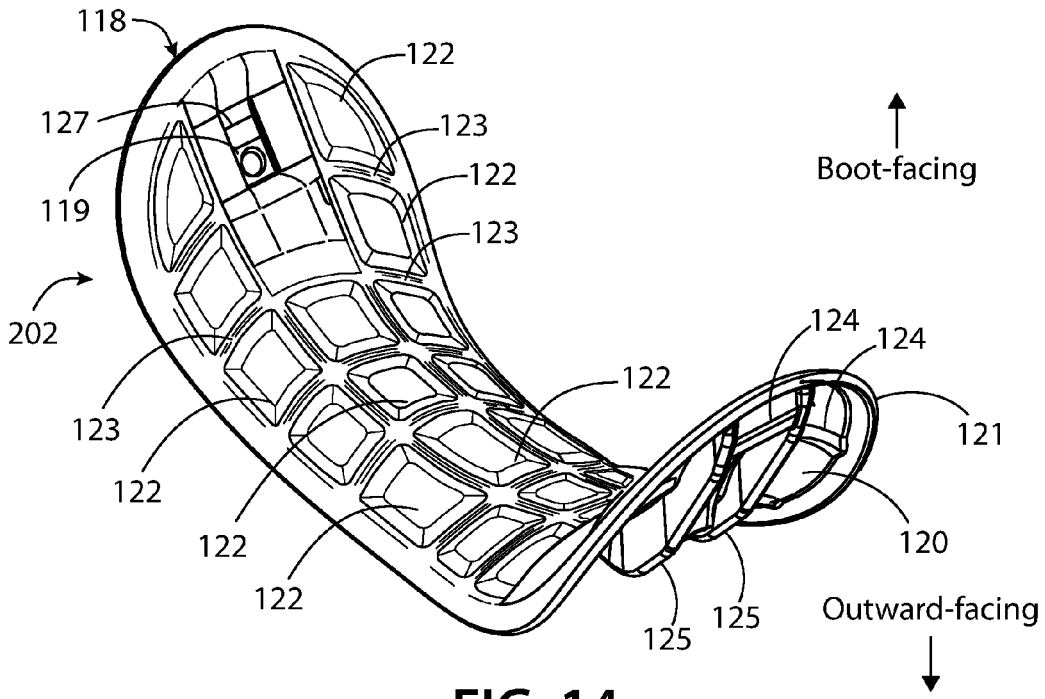
FIG. 14 illustrates a top and rear (i.e. boot-side) perspective view of an alternative ankle strap without the center aperture of the ankle strap of FIGS. 3-13.
Figure 15:
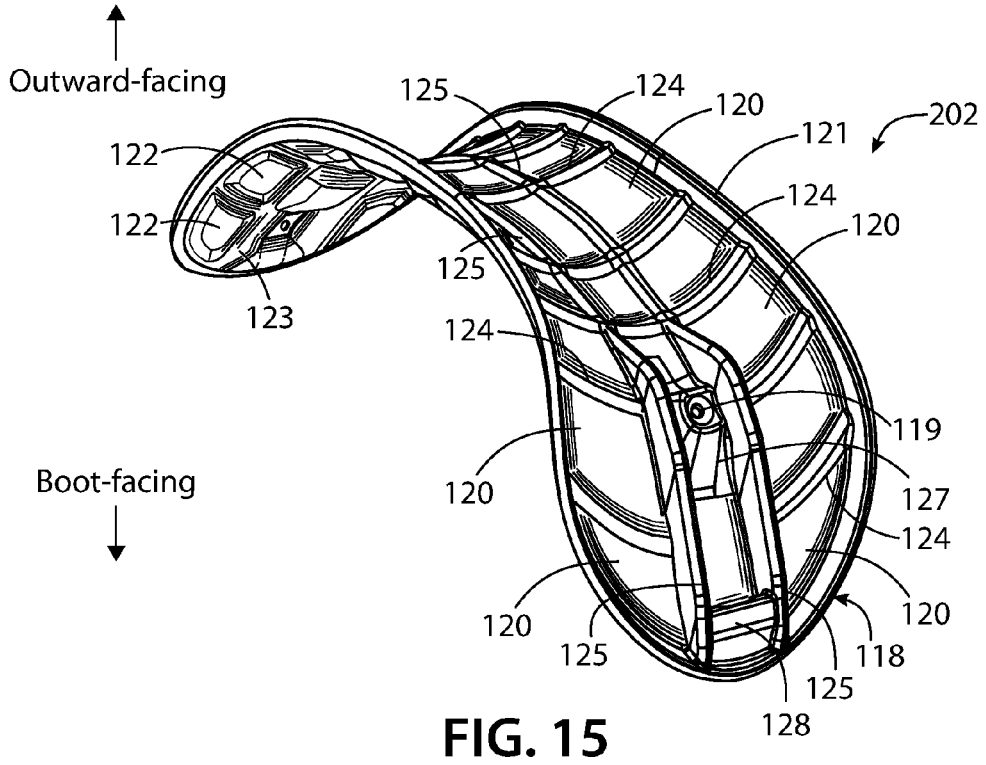
FIG. 15 illustrates a bottom and front (i.e. outward-facing) perspective view of an ankle strap of FIG. 14.
Figure 16:
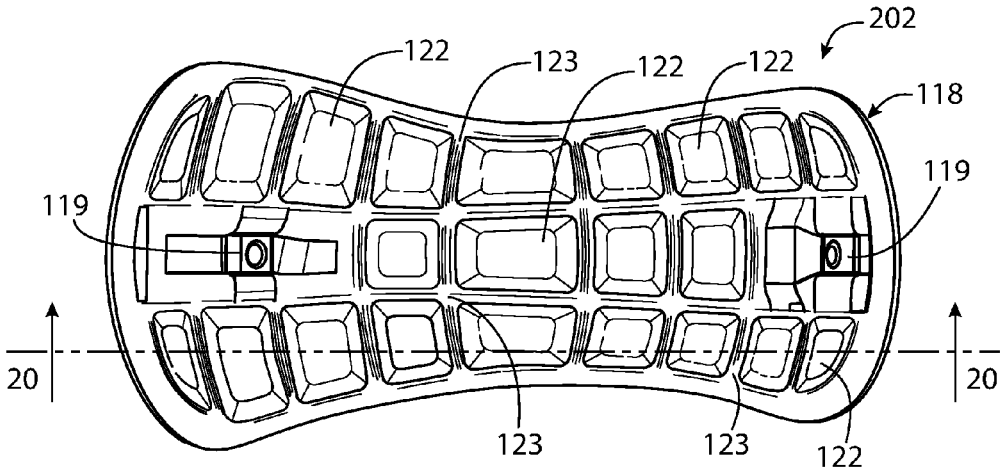
FIG. 16 illustrates a rear (i.e. boot-side) elevation view of an ankle strap of FIG. 14.

FIG. 13 shows a top (boot-side) exploded perspective view of the one-piece molding 118 and the threaded inserts 119. While this is illustrated for the ankle strap 102, the description for FIG. 13 applies to the ankle strap 202 of FIGS. 14-22, the ankle strap 302 of FIGS. 33-36, the ankle strap 402 of FIGS. 37-40, the ankle strap 502 of FIGS. 41-44, and the toe strap 103 of FIGS. 23-32. Referring to FIG. 13, the threaded insert 119 is inserted into the rear of the insert support 127 detented into the boot-facing surface 123. The threaded fastener includes a barbed end 119*a* that press fits into the rear surface of the insert support 127. Boot binding connecting hardware such as ratcheting buckles 114 or length adjuster straps 112 can be attached to the ankle strap 102, ankle strap 202, ankle strap 302, ankle strap 402, ankle strap 502, or toe strap 103 by a threaded fastener 111, as illustrated in FIGS. 2 and 3. The threaded fastener 111 can be any threaded fastener suitable, such as a machine screw or bolt, capable of withstanding reasonable forces encountered during the operation of the snowboard or splitboard. In FIGS. 5, 15, 24, 34, 38, and 42 a threaded fastener can be screwed through the surface of the insert support 127 on the outward-facing surface of the ankle strap 102, ankle strap 202, ankle strap 302, ankle strap 402, ankle strap 502, or toe strap 103 and into the threaded insert 119 mounted on the boot-facing side of the one-piece molding 118. The threaded insert 119 is engaged and pulled into the rear surface of the insert support 127 as the threaded fastener is tightened. The length-wise ribs 125 act as rigid mounting surfaces for mounting hardware such as the ratcheting buckle 114 of FIGS. 2 and 3. The top surface of the length-wise ribs 125 near the insert support 127 is flat to help accommodate such hardware. In addition, a slot 128 mounted laterally and proximate to the end of the one-piece molding 118 is used to accommodate mounting hardware, for example, for the ratcheting buckle 114 of FIGS. 2 and 3. The height of the length-wise ribs 125 can act as a guide for length adjuster strap 112 of FIGS. 2 and 3 and help keep it from loosening during operation. In addition to the advantages described, the threaded insert 119 is easily removable for field servicing or replacement thanks to the barbed end 119*a*. This is especially helpful in the isolated backcountry.

Figure 5:
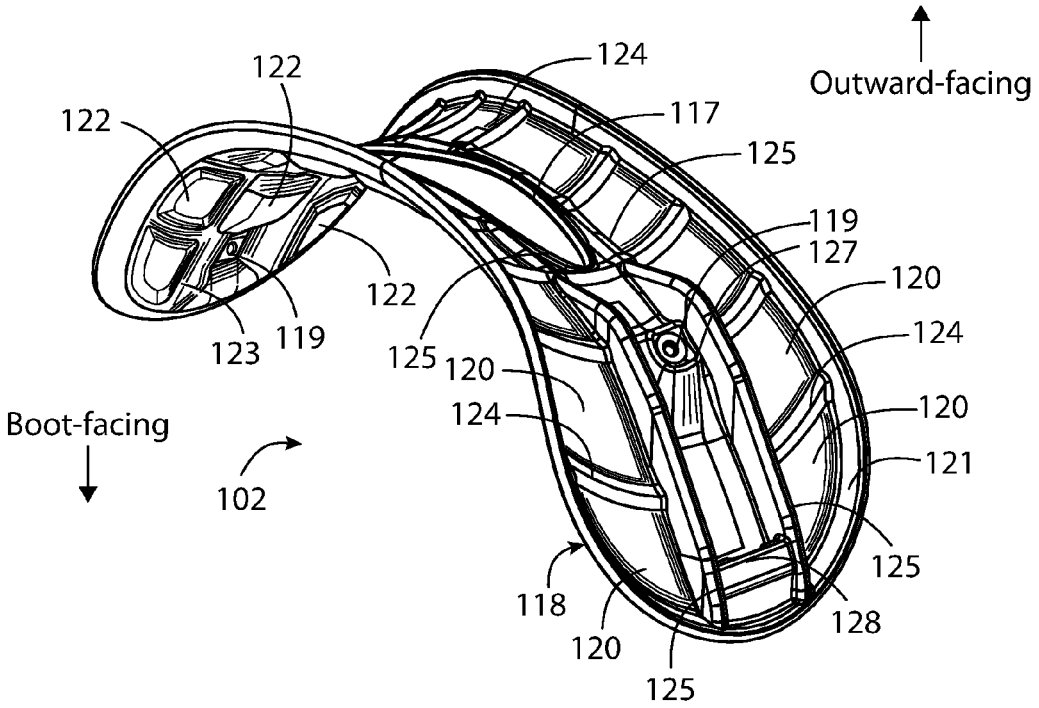
FIG. 5 illustrates a front bottom perspective view (i.e. outward-facing) perspective view of an ankle strap of FIG. 4.
Figure 6:
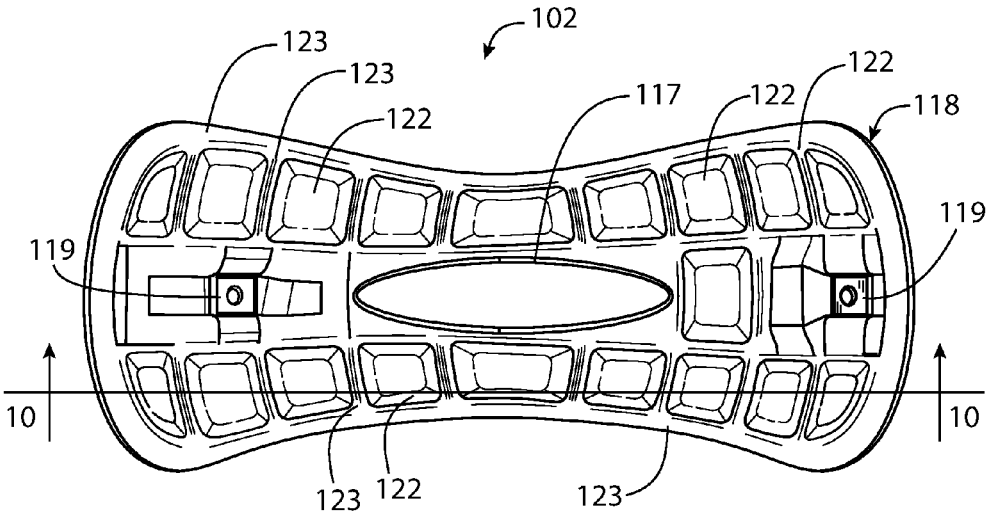
FIG. 6 illustrates a rear (i.e. boot-side) elevation view of an ankle strap of FIG. 4.

Thus far, this Description, has focused on similar and equivalent features and structures among the ankle strap 102 of FIGS. 4-13, the ankle strap 202 of FIGS. 14-22, the ankle strap 302 of FIGS. 33-36, the ankle strap 402 of FIGS. 37-40, the ankle strap 502 of FIGS. 41-44, and the toe strap 103 of FIGS. 23-32. As previously discussed, the ankle strap 102 is generally designed for riders who favor maneuverability over speed. The ankle strap 202 is generally designed for riders who prefer speed over maneuverability. As briefly discussed, the main difference between the ankle strap 102 of FIGS. 4-13, the ankle strap 202 of FIGS. 14-22 is the central aperture 117 in the ankle strap 102 depicted in FIGS. 4-8, and 13. Referring to FIGS. 5 and 7, the central aperture 117 is positioned along the length-wise centerline of the ankle strap 102 between the length-wise ribs 125. The central aperture 117 is shown as oval shape as the inventor has determined that shape helps to resists tearing. In addition, the oval shape also accommodates top and bottom pinching or flexing of the ankle strap 102. For example, as the rider bends their ankle, the top and the bottom of the strap flex or pinch closer together. The length of the central aperture 117 can be lengthened to create a more flexible strap over the top of the boot or shortened to create a stiffer strap.

The ankle strap 302 of FIGS. 33-36, the ankle strap 402 of FIGS. 37-40, the ankle strap 502 of FIGS. 41-44 demonstrate other combinations, of ribbing patterns and corresponding flex member shapes and sizes in order to adjust performance and accommodate different splitboarding and snowboarding styles. While the central aperture 117 of the ankle strap 102 (FIGS. 4-7, 8, and 13) and the toe strap 103 (FIGS. 23-27) are absent, the inventor envisions that this feature can be readily added by the reader by the descriptions and illustrative examples given, without undue experimentation.

Figure 24:
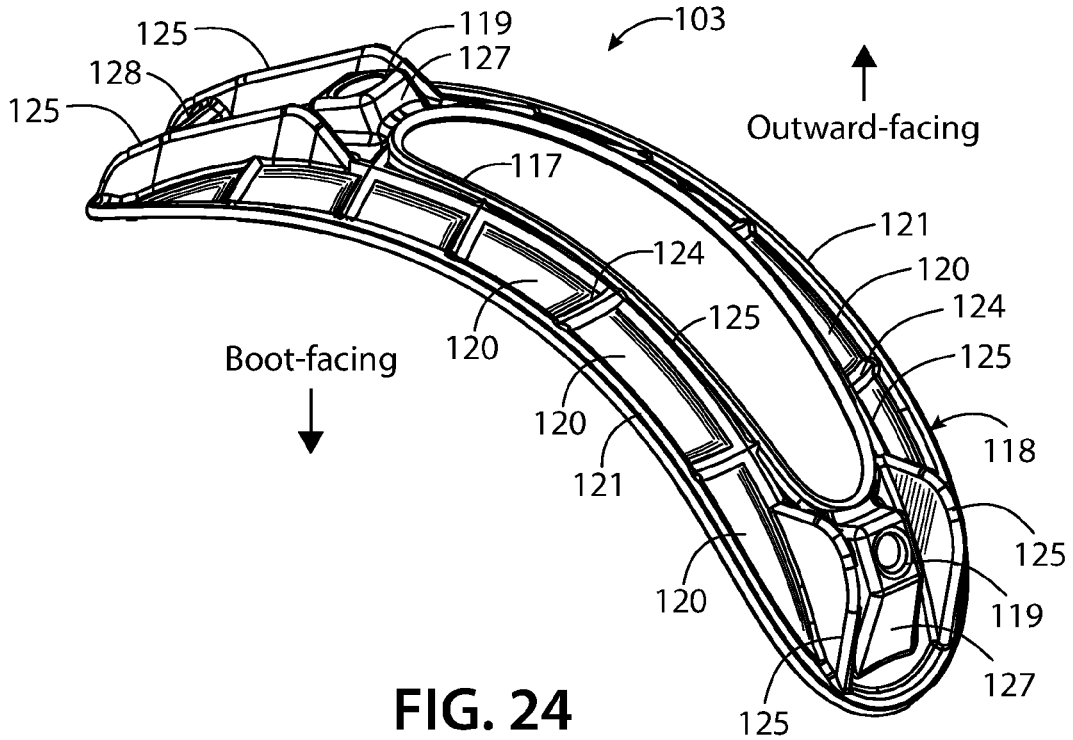
FIG. 24 illustrates a bottom and front (i.e. outward-facing) perspective view of the toe strap of FIG. 23.
Figure 25:
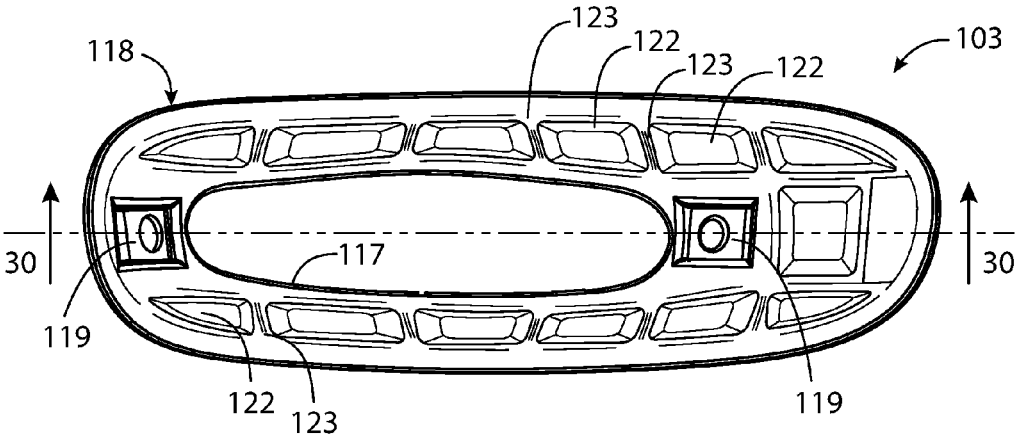
FIG. 25 illustrates a rear (i.e. boot-side) elevation view of the toe strap of FIG. 23.
Figure 26:
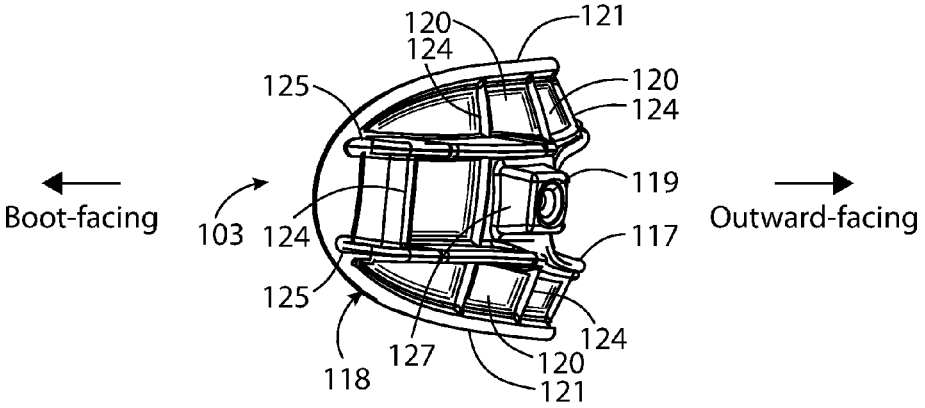
FIG. 26 illustrates a right and side elevation view of the toe strap of FIG. 23.

The toe strap 103 of FIGS. 23-32 is designed to be worn at the end of the rider's snow boot rather than the top of their boot. Referring to FIGS. 23-25, and 27, the toe strap 103 has a central aperture 117 to help the toe strap 103 remain in position over the convex end of the boot. Referring to FIGS. 24 and 27, the central aperture 117 is positioned along the length-wise centerline of the toe strap 103 between the length-wise ribs 125. The length-wise ribs 125 are set relatively wider apart than the length-wise ribs 125 of the ankle strap 102 in FIGS. 5 and 7. This allows for a central aperture 117 that is relatively wider to keep the strap in place when used over the toe end of the boot. The toe end of the rider's boot is essentially rigid. The toe strap does not flex significantly once tightened down. In contrast, the top of the boot where the ankle strap 102 is located is much more flexible, and changes shape during normal snowboarding movements.

Referring to FIGS. 6, 7, 16, 17, 25, 27, 35, 36, 39, 40, 43, and 44, the ankle strap 102 (FIGS. 6 and 7), the ankle strap 202 (FIGS. 16 and 17), the ankle strap 303 (FIGS. 35 and 36), the ankle strap 402 (FIGS. 39 and 40), the ankle strap 502 (FIGS. 43 and 44), having length-wise and width-wise asymmetry. The width-wise asymmetry for the ankle strap 102, ankle strap 202, ankle strap 302, ankle strap 402, and ankle strap 502 accounts for the contour of the ankle portion of the boot. The length-wise asymmetry accounts for the inside of boot being a different shape than the outside of the boot. Likewise, the shape of the strap will vary from right to left feet as shown in FIG. 1 which shows both right and left foot straps. FIGS. 2, 3, 23-32 are right foot straps, FIGS. 4-22 and 33-44 are left foot straps.

Ankle and toe straps for splitboard and snowboard boot bindings have been described. It is not the intent of this disclosure to limit the claimed invention to the examples, variations, and exemplary embodiments described in the specification. Those skilled in the art will recognize that variations will occur when embodying the claimed invention in specific implementations and environments. For example, boot bindings 101, ratcheting buckles 114, length adjuster straps 112, splitboards 100, are illustrated in FIGS. 1-3. They are examples of typical combinations that can be used with the ankle straps 102, ankle strap 202, ankle strap 302, ankle strap 402, and ankle strap 502, and toe strap 103 or their equivalents. The inventor envisions that his ankle straps 102 (FIGS. 3-13), ankle straps 202 (FIGS. 14-22), ankle strap 302 (FIGS. 33-36), ankle strap 402 (FIGS. 37-40), ankle strap 502 (FIGS. 41-44), and toe straps 103 (FIGS. 23-32) can be used with a wide variety of splitboards, snowboards, splitboard bindings, snowboard bindings, and associated accessory hardware.

It is possible to implement certain features described in separate embodiments in combination within a single embodiment. Similarly, it is possible to implement certain features described in single embodiments either separately or in combination in multiple embodiments. For example, the ankle strap 102 of FIGS. 4-13 is illustrated with a central aperture 117 while the ankle strap 202 of FIGS. 14-22 is not. The toe strap 103 of FIGS. 23-32 is shown with a central aperture 117. It is within the scope of the claimed invention to implement a toe strap 103 without a central aperture 117. Likewise, ankle strap 302 (FIGS. 33-36), ankle strap 402 (FIGS. 37-40), and ankle strap 502 (FIGS. 41-44) are shown without central apertures 117 but could readily be implemented with central apertures 117 by following the illustrative examples of ankle strap 102 and toe strap 103. It is the intent of the inventor that these variations fall within the scope of the claimed invention.

While the examples, exemplary embodiments, and variations are helpful to those skilled in the art in understanding the claimed invention, it should be understood that, the scope of the claimed invention is defined solely by the following claims and their equivalents.

What is claimed is:

1. A boot binding strap for snow gliding boards, comprising:

a one-piece molding with sufficient rigidity to hold a length-wise arcuate shape, the one-piece molding including a boot-facing surface and an outward-facing surface opposing the boot-facing surface;

the outward-facing surface including three or more ribs forming a continuous interconnected ribbed structure;

the three or more ribs including two or more non-perimeter ribs and a perimeter rib; and an indented portion on the outward-facing surface forms an outdented portion on the boot-facing surface, the indented portion bound by at least three ribs of the three or more ribs.

2. The boot binding strap of claim 1, wherein:

a first thickness between the indented portion and the outdented portion is less than each of a first rib height, a second rib height, and a third rib height of the at least three ribs of the three or more ribs that bound the indented portion.

3. The boot binding strap of claim 2, wherein:

the indented portion is first indented portion and the outdented portion is a first outdented portion;

the at least three ribs of the three or more ribs is a first three ribs of the three or more ribs;

a second indented portion on the outward-facing surface forms a second outdented portion on the boot-facing surface, the second indented portion bound by a second at least three ribs of the three or more ribs; and the first indented portion and the second indented portion are bound by at least one common rib portion of the three or more ribs.

4. The boot binding strap of claim 1, further including:

a threaded insert;

the outward-facing surface including a first length-wise rib and a second length-wise rib, each extending from a first length-wise end of the one-piece molding and positioned on opposing sides of a length-wise centerline; and the threaded insert indented below the outdented portion and positioned between the first length-wise rib and the second length-wise rib.

5. The boot binding strap of claim 4, wherein:

the first length-wise rib and the second length-wise rib are taller proximate to the threaded insert than away from the threaded insert.

6. The boot binding strap of claim 4, wherein:

a second thickness between the boot-facing surface and the outward-facing surface proximate to the first length-wise rib and the second length-wise rib; and the second thickness is less than a first length-wise rib height and a second length-wise rib height located proximate to the second thickness.

7. A boot binding strap for snow gliding boards, comprising:

a one-piece molding with sufficient rigidity to hold a length-wise arcuate shape, the one-piece molding including a boot-facing surface and an outward-facing surface opposing the boot-facing surface;

a first lateral rib, a second lateral rib, a length-wise rib, and a perimeter rib, each extending directly outward from the outward-facing surface and together forming a continuous interconnected ribbed structure; and an indented portion on the outward-facing surface forms an outdented portion on the boot-facing surface, the indented portion bound by at least three ribs selected from the first lateral rib, the second lateral rib, the perimeter rib, and the length-wise rib.

8. The boot binding strap of claim 7, wherein:

a first thickness between the indented portion and the outdented portion is less than a height of each of the at least three ribs that bound the indented portion.

9. The boot binding strap of claim 8, wherein:

the indented portion is first indented portion and the outdented portion is a first outdented portion;

a second indented portion on the outward-facing surface forms an second outdented portion on the boot-facing surface, bound by at least three ribs selected from the first lateral rib, the second lateral rib, the perimeter rib, and the length-wise rib; and the first indented portion and the second indented portion are bound by at least one common rib.

10. The boot binding strap of claim 7, further including:

a threaded insert;

the length-wise rib is a first length-wise rib;

a second length-wise rib extending directly from the outward-facing surface;

the first length-wise rib and the second length-wise rib each extending from a first length-wise end of the one-piece molding and positioned on opposing sides of a length-wise centerline; and the threaded insert indented below the outdented portion and positioned between the first length-wise rib and the second length-wise rib.

11. The boot binding strap of claim 10, wherein:

the first length-wise rib and the second length-wise rib are taller proximate to the threaded insert than away from the threaded insert.

12. The boot binding strap of claim 10, wherein:

a second thickness between the boot-facing surface and the outward-facing surface proximate to the first length-wise rib and the second length-wise rib; and the second thickness is less than a first length-wise rib height and a second length-wise rib height located proximate to the second thickness.

* * * * *